US008157112B2

(12) United States Patent
Bojie

(10) Patent No.: US 8,157,112 B2
(45) Date of Patent: Apr. 17, 2012

(54) ARCUATE DISPLAY STAND

(75) Inventor: Andrew Bojie, Rogers, AR (US)

(73) Assignee: Englander Container & Display Co., Waco, TX (US)

( * ) Notice: Subject to any disclaimer, the term of this patent is extended or adjusted under 35 U.S.C. 154(b) by 588 days.

(21) Appl. No.: 12/321,395

(22) Filed: Jan. 21, 2009

(65) Prior Publication Data

US 2010/0181443 A1 Jul. 22, 2010

(51) Int. Cl.
*A47F 5/00* (2006.01)

(52) U.S. Cl. ..... 211/135; 211/72

(58) Field of Classification Search ..... 211/135, 211/72, 73, 189, 195, 149; 248/146, 127; 108/51.11, 193, 180, 115; 206/740, 744, 206/561, 736; 220/4.28, 4.29, 4.31, 4.32, 220/528, 529, 532, 533, 6, 7, 668
See application file for complete search history.

(56) References Cited

U.S. PATENT DOCUMENTS

| | | | | | |
|---|---|---|---|---|---|
| 2,113,288 | A | * | 4/1938 | Berger | 229/107 |
| D116,281 | S | * | 8/1939 | Dillon | D6/436 |
| 3,123,207 | A | * | 3/1964 | Goldstein | 206/763 |
| 3,757,934 | A | * | 9/1973 | Taub | 206/768 |
| 3,863,575 | A | | 2/1975 | Kuns et al. | 111/108 |
| 3,877,396 | A | | 4/1975 | Patterson | 111/108 |
| 3,997,220 | A | | 12/1976 | Mayer | 242/312 |
| 3,999,662 | A | * | 12/1976 | Barnhardt | 211/126.16 |
| 4,062,302 | A | * | 12/1977 | Krizan | 108/60 |
| 4,373,449 | A | * | 2/1983 | Klaus et al. | 108/60 |
| 4,379,432 | A | | 4/1983 | Grossman | 153/108 |
| 4,530,548 | A | * | 7/1985 | Spamer et al. | 312/45 |
| 4,610,363 | A | | 9/1986 | Flum et al. | 74/211 |
| 4,618,115 | A | | 10/1986 | Belokin, Jr. | 174/248 |
| 4,809,847 | A | | 3/1989 | Schneider | |
| 5,141,105 | A | | 8/1992 | Maye | 44/206 |
| 5,190,211 | A | | 3/1993 | Stoddard et al. | |
| 5,458,411 | A | * | 10/1995 | Moss | 312/259 |
| 5,702,011 | A | * | 12/1997 | Carroll | 211/135 |
| 5,984,120 | A | | 11/1999 | Johnske | |
| 6,010,015 | A | * | 1/2000 | Lin | 211/40 |
| 6,105,796 | A | * | 8/2000 | Buchanan et al. | 211/128.1 |
| 6,267,255 | B1 | | 7/2001 | Brush | |
| 6,431,364 | B1 | * | 8/2002 | Saladyga | 206/767 |
| 6,612,669 | B2 | * | 9/2003 | Grueneberg | 312/259 |
| D497,062 | S | * | 10/2004 | Chang | D6/479 |
| 6,832,562 | B2 | * | 12/2004 | Tabor et al. | 108/55.1 |
| 7,131,543 | B2 | | 11/2006 | Mason | |
| 7,185,771 | B2 | | 3/2007 | Moss et al. | 72/211 |
| 7,252,200 | B1 | * | 8/2007 | Hester | 211/72 |
| D607,233 | S | * | 1/2010 | Bojie | D6/449 |
| D607,236 | S | * | 1/2010 | Bojie | D6/474 |
| 2005/0194274 | A1 | * | 9/2005 | Li et al. | 206/320 |
| 2006/0118502 | A1 | * | 6/2006 | Polvere et al. | 211/135 |
| 2006/0151407 | A1 | * | 7/2006 | Virvo | 211/72 |
| 2008/0053867 | A1 | * | 3/2008 | Robbins | 206/756 |

* cited by examiner

*Primary Examiner* — Jennifer E. Novosad
(74) *Attorney, Agent, or Firm* — Keisling & Pieper PLC; Meredith K. Lowry

(57) ABSTRACT

A display assembly is provided using an interior frame with an arcuate wrapped exterior having an advertising element. The frame is made from corrugated paper or a thin walled plastic.

18 Claims, 13 Drawing Sheets

ARCUATE DISPLAY STAND

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to the field of display systems in general. In particular, the present invention relates specifically to a display system having a removable arcuate panel with a graphic element.

2. Description of the Known Art

As will be appreciated by those skilled in the art, corrugated cardboard displays provide a means for inexpensively advertise and display products in a retail or display environment. Details of a typical cardboard display are contained in United States Patent Publication No. 2006/0118502 filed by Polvere et al. on Nov. 22, 2005; U.S. Pat. No. 3,863,575 issued to Kuns et al. on Feb. 4, 1975; U.S. Pat. No. 3,877,396 issued to Patterson on Apr. 15, 1975; U.S. Pat. No. 3,997,220 issued to Mayer on Dec. 14, 1976; U.S. Pat. No. 4,379,432 issued to Grossman on Apr. 12, 1983; U.S. Pat. No. 4,610,363 issued to Flum et al. on Sep. 9, 1986; U.S. Pat. No. 4,618,115 issued to Belokin on Oct. 21, 1986; U.S. Pat. No. 4,809,847 issued to Schneider on Mar. 7, 1989; U.S. Pat. No. 5,141,105 issued to Maye on Aug. 25, 1992; U.S. Pat. No. 5,190,211 issued to Stoddard et al. on Mar. 2, 1993; U.S. Pat. No. 5,758,783 issued to Maglione on Jun. 2, 1998; U.S. Pat. No. 5,984,120 issued to Johnske on Nov. 16, 1999; U.S. Pat. No. 6,105,796 issued to Buchanan et al. on Aug. 22, 2000; U.S. Pat. No. 6,135,288 issued to Kim on Oct. 24, 2000; U.S. Pat. No. 6,267,255 issued to Brush on Jul. 31, 2001; U.S. Pat. No. 6,394,290 issued to Walsh et al. on May 28, 2002; U.S. Pat. No. 6,431,364 issued to Saladyga on Aug. 13, 2002; U.S. Pat. No. 6,749,071 issued to Caterinacci on Jun. 15, 2004; U.S. Pat. No. 6,966,447 issued to Hiltke et al. on Nov. 22, 2005; U.S. Pat. No. 7,131,543 issued to Mason on Nov. 7, 2006; and U.S. Pat. No. 7,185,771 issued to Moss et al. on Mar. 6, 2007. Each of these patents is hereby expressly incorporated by reference in their entirety.

In the past, display assemblies have been designed for both shipping and display purposes. However, these display assemblies have had a variety of limitations which adversely affect their function for shipping or display, or both. For example, display assemblies which are rectangular in structure have either a solid rectangular exterior or several rectangular elements forming a larger cube structure with an illustrated exterior have been known for some time. Some of these display assemblies are complicated to manufacture and, therefore, are costly, while others are not sufficiently sturdy to support and contain significant weight during shipment. Others have significant limitations which inhibit use on pallets and limit the ability to properly handle the display assemblies during shipment. Many display assemblies have required difficult or time-consuming in-store construction, therefore reducing retailer profitability and efficiency. Many of these display assemblies require permanent adhesive for securing the illustrated exterior which then destroys the display assembly for future use with a different illustration. Hence, a need exists for cost-efficient, aesthetic display assembly which can be easily constructed and utilize serial illustrated exteriors.

United States Patent Publication No. 2006/0118502 filed by Polvere et al. on Nov. 22, 2005 is entitled Merchandise display system. Its abstract describes an inexpensive and easy to assemble merchandise display system is disclosed. The system includes at least one elongated wall having front and rear edges and including a plurality of slits extending from the front edge into the wall, and at least one shelf having front and rear edges and including a plurality of slits extending from the rear edge into the shelf. The wall and shelf slits are configured to be matingly engageable so that the shelf and wall can be selectively interlocked by engagement of a shelf slit and a wall slit to form a skeletal structure that defines uniform or non-uniform areas, as desired.

U.S. Pat. No. 3,863,575 issued to Kuns et al. on Feb. 4, 1975 entitled Display stand. Its abstract states the display stand of the present invention is formed from a plurality of blanks of semi-rigid material such as corrugated paperboard which are folded, arranged and secured to one another to result in a one-piece display stand construction that is shipped in a knocked down condition for set-up at the point of use. The details of construction include a double thick back panel flanked by quadruple thick side panels to yield a display stand having an open frontal portion, with a plurality of shelf structures hingedly attached to the back panel and supported in use by support bars which lie beneath the shelves and which extend between the two side panels.

U.S. Pat. No. 3,877,396 issued to Patterson on Apr. 15, 1975 entitled Knockdown display rack. Its abstract describes a knockdown display rack including a plurality of horizontal shelves, preferably of masonite; a plurality of vertical support columns, preferably of folded fibrous or plastic sheet material, each being slotted in the interior at the same heights to slidably receive and support the corresponding peripheries of the shelves; and a sleeve-like member, preferably of fibrous or plastic sheet material, slidably engaging the exteriors of the columns to enclose and restrain the columns in positions supporting the shelves. The shelves preferably have tabbed cutout areas between the uppermost and lowermost shelves to permit the display of merchandise on shelves.

U.S. Pat. No. 3,997,220 issued to Mayer on Dec. 14, 1976 entitled Display units. Its abstract describes basic components of unit are: 4 times. 8 foot panel supported to stand in an upright position: openings or cutouts in the panel; each opening contains a pop-in/pop-out molded plastic display tray for storing and/or displaying articles. Panels have quick connect/disconnect fasteners for joining. As used in a retail store, the unit simulates a wall and forms visible, accessible display means.

U.S. Pat. No. 4,379,432 issued to Grossman on Apr. 12, 1983 entitled Article display stand. The abstract describes an article display stand is formed of one pair of identical semi-cylindrical vertical support members and one pair of identical horizontal support members. The horizontal support members have means thereon to hold the vertical support members in position. The vertical support members are preferably formed of transparent material to permit viewing therethrough.

U.S. Pat. No. 4,610,363 issued to Flum et al. on Sep. 9, 1986 entitled Container assembly for storage and display of articles. The abstract describes A container assembly for storage and display of articles formed of a plurality of parts that can be stored and shipped in substantially flat form and that can be assembled to a three-dimensional form thereby both storing the articles that are for sale and representing a display of one of the articles. A cylindrical body comprises two or more body panels preferably of resilient plastic biasing the panels toward a normally flat condition. Cooperative elongated interlocking channel members for locking the body panels together at adjacent side edges to form the cylinder. The channels are formed to interfit readily when the body panel margins adjacent the edges are substantially coplanar. The pressure biasing the body panels toward a flat position locks the interlocking channels together when the panels are curved to form a cylinder. Flanges on the channel members bear against the body panel margins adjacent the edges to stiffen those panel margins to maintain a smooth continuation of the cylindrical shape at and through the lines of interlock. Partition panels and a floor assembly are positioned within the cylindrical body. A sheet is held by interlockable channel members in a cylindrical form and has a flat lid snapped onto it to form a replica of a bottle cap. The cap replica fits on top of neck portions of the partition panels.

U.S. Pat. No. 4,618,115 issued to Belokin on Oct. 21, 1986 entitled Display device module with multiple shelves. The abstract states according to the invention, a collapsible display module has a wall blank with wall panels connected end to end foldably relative to each other to define a continuous wall structure. The wall blank is convertible between a flattened state wherein it can be readily stored and transported, and an expanded display state wherein pairs of opposed, facing panels bound a storage space. First and second flaps associated with each of the wall panels of one wall panel pair interconnect and define spaced shelves for placement of articles to be displayed.

U.S. Pat. No. 4,809,847 issued to Schneider on Mar. 7, 1989 entitled Shipping and display container for plural stacked boxes. The abstract describes a shipping and display container for retail sales of small items such as candy includes a plurality of vertically stacked boxes, each with a front opening for removal of merchandise and a vertical divider for mechanical strength. The boxes can be glued together. A display tray is glued to the top of the stacked boxes. A decorative wrapper, which is glued around three sides of the stacked boxes and display tray, includes easily removable perforated access panels aligned with the front openings in the boxes. The access panels are left in position during shipment and are removed for display. A base pallet is attached to the bottom of the container for protection thereof and for raising the level of the container to facilitate display.

U.S. Pat. No. 5,141,105 issued to Maye on Aug. 25, 1992 entitled Display rack assembly. The abstract describes a display rack is described, which is fabricated from a minimum number of recyclable, cellulosic components. The unit is easy to assemble and disassemble without a need for tools, and may be pre-packed for gravity feed of articles to be merchandised.

U.S. Pat. No. 5,190,211 issued to Stoddard et al. on Mar. 2, 1993 entitled Snack display. The abstract describes a snack display is formed from a unitary blank. The blank includes a plurality of parallel spaced apart cross pieces together with a pair of side pieces foldably joined to opposite ends of the cross pieces respectively. The side pieces are of arcuate cross sectional configuration and planar panels are foldably joined to edges of the side pieces which are remote from the cross pieces. Outer edges of the planar panels which are remote from the side pieces are joined together and a plurality of shelves are foldably joined respectively to the cross pieces.

U.S. Pat. No. 5,758,783 issued to Maglione on Jun. 2, 1998 entitled Stackable tray and display stand. The abstract states a tray is formed of a single corrugated sheet of paperboard and has two opposite side walls formed by overlapping panels creating a slot between the panels in each side wall. A pair of tabs depends from each side wall for engaging the slots of a next lower tray. A support box has crossed upright support members therein to support the trays. The box has two upstanding tabs on opposite sides to engage the side wall slots at the bottom wall of the lowermost trays. A triangular cap has two depending tabs on each side for engaging the slots of the trays in an uppermost tier. Straps on each tray secure that tray to slots in the next upper tray. The tray bottom wall is formed into two sections with a forward section inclined and formed of multiple layers of sheets to enhance the strength of the forward section. The trays are stacked in back-to-back relation in any number of levels and have a tree-like appearance from the side and are accessible from opposite fronts of the display stand.

U.S. Pat. No. 5,984,120 issued to Johnske on Nov. 16, 1999 entitled Point-of-purchase display system and method for formation thereof. The abstract describes a point-of-purchase display system for shipping and displaying articles therewithin, the display system utilizes facilitated articulation while maximizing display area, and the display system comprises at least one modular tray member. The at least one modular tray member includes an inner liner having a tray support member and a tray divider member for securing and displaying articles therein. An outer tray is operably associated with the inner liner, and the outer tray has a bottom panel, a back panel, and two side panels. Each of the side panels includes a biasable flap, which, upon articulation, covers the exposed side wall edges of both the outer tray and inner liner. Each biasable flap includes a locking tab for operably engaging a tab locking slot on the bottom panel to secure the biasable flap therein. The invention further includes a method for forming a point-of-purchase display system for shipping and displaying articles therewithin.

U.S. Pat. No. 6,105,796 issued to Buchanan et al. on Aug. 22, 2000 entitled Merchandising display lane blocker. The abstract states a checkout lane blocker and merchandising display stand having a base member, a plurality of wheels located below the base member, an outer shell providing walls on top of the base member, an internal support structure disposed on the base member and including a stepped shelf, and a plurality of merchandise display trays disposed on top of the stepped shelf for holding merchandise for display. The outer shell, internal support structure, and merchandise trays are preferably made of corrugated material and the display therefore is lightweight, inexpensive, and easily recycled. The lane blocker merchandising display may be easily moved into position to block a checkout lane in a store when the checkout lane is closed.

U.S. Pat. No. 6,135,288 issued to Kim on Oct. 24, 2000 entitled Corrugated board packaging box. The abstract describes a corrugated board packaging box including an opening portion which is formed on a front surface portion of a box body, through which goods are taken in and out. On both sides of the front surface portion, a cut-off portion is formed to cut off by a cutting line, defined by a vertical supporting member disposed on the intermediate portion of the front surface, and on an edge of the one side of the cut-off portion, a cut-off protrusion is disposed by forming an inclined cutting line.

U.S. Pat. No. 6,267,255 issued to Brush on Jul. 31, 2001 entitled Merchandiser with shroud and header forming panels. The abstract describes a merchandiser which has a product containing interior region is provided with a plurality of panels secured to the top surface of the merchandiser. The panels are foldable between a shroud forming position in which they cover the side faces of the merchandiser and a header forming position in which they project upwardly from the top surface of the merchandiser. The panels, when in the header forming position interlock with and hold one another in the header forming position. When the panels are in the header forming position, the product receiving interior region of the merchandiser is visible through the side faces of the merchandiser.

U.S. Pat. No. 6,394,290 issued to Walsh et al. on May 28, 2002 entitled Display stand. The abstract is describes a foldable, point-of-purchase display stand is disclosed. The display stand is manufactured from a piece sheet of corrugated board. The display stand has a shelf that is secured by a hook affixed with a pop rivet or eyelet. The disclosed stand is stable for weight-bearing for use in the advertising industry for displaying books and magazines. The display stand of the invention is quickly and easily assembled.

U.S. Pat. No. 6,431,364 issued to Saladyga on Aug. 13, 2002 entitled Display with removeable informational panel. The abstract describes a display tray is provided for visually displaying a plurality of products for sale, and also for displaying promotional information regarding the products within the tray. The display tray includes a tray member into which the products for sale are placed, and a display member separate from and removeably connected to the tray member for displaying promotional information regarding the products within the tray member.

U.S. Pat. No. 6,749,071 issued to Caterinacci on Jun. 15, 2004 entitled Merchandizing display. The abstract describes a merchandise display device for dispensing and displaying digital media cases. Digital media cases are inserted vertically into the opening between the front panel and the lateral supports. This opening limits the number of cases which can be removed and/or inserted at one time. The width of the opening allows only two cases to be inserted or removed at a time, to deter theft. The opening, however, still allows for easy access when removing or inserting the cases. A replaceable pusher is attached to the back wall of the unit to bias the digital media cases toward the front panel. The display units are broken into two separate components, a right and left side. The components allow for flexibility in arranging the display system, depending on the need of the vendor. The invention provides a storage display system which continuously maintains the organized orientation of digital media cases, displays the covers of these cases, permits easy access and use of the stored objects and allows for flexibility so that the storage units are easy to install, reconfigure, and remove.

U.S. Pat. No. 6,966,447 issued to Hiltke et al. on Nov. 22, 2005 entitled Corrugated display base. The abstract describes an upright display stand for mounting a hanging display tray erected from a corrugated paperboard blank. The display stand includes rectangular front panel having a locking slot for engagement of a transverse brace with the upper edge of the front panel including spaced apart notches for the engagement of hooks on the back of the hanging display tray. The display stand also includes a first integral side panel and a second integral side panel of generally triangular configuration and a rear panel. The upper end of the rear panel includes an integral brace section which folds downwardly and inwardly to engage the locking slot formed in the front panel to create the transverse brace. The display stand, when fully assembled, is generally rigid and stable and well suited to support a hanging display tray.

U.S. Pat. No. 7,131,543 issued to Mason on Nov. 7, 2006 entitled Display device. The abstract states a display device for at least one modular merchandise unit having a substantially flat base includes a base, a housing supported by the base, a cover, at least one wheel connected to the base, and at least one shelf supported in the housing for receiving the base of the merchandise unit. The housing includes parallel first and second side walls and a third side wall connected to the first and second side walls. The cover is disposed on an upper portion of the first, second and third side walls.

U.S. Pat. No. 7,185,771 issued to Moss et al. on Mar. 6, 2007 entitled Foldable stepped display stands. The abstract describes the foldable display stand has a stepped display shelving portion removably mounted over a foldable support base. The shelving portion is formed by folding various parts of a configuration formed on a single sheet material. The configuration includes a plurality of rectangular panels connected by a plurality horizontal fold lines. Side extensions are formed on the two side edges of the rectangular panels which are foldable to form side wall of the shelves and the side walls are mounted in place by mounting tabs formed in the side extensions and mounting slots formed in the selected rectangular panels. Side extensions having a unique design are adapted to form reinforced side walls of the shelves.

These prior art patents are very limited in their teaching and utilization, and an improved display assembly is needed to overcome these limitations.

SUMMARY OF THE INVENTION

The present invention is directed to improved display assemblies. In accordance with one exemplary embodiment of the present invention, a display assembly is provided using an interior frame with an arcuate wrapped exterior having an advertising element. The frame is made from corrugated paper or a thin walled plastic. Advantages of the present invention include: a compact shipping configuration; a lightweight shipping configuration; efficient use of materials; easy set up for the display without requiring tools; efficient display assembly; easy restocking of the display; easy change out of display graphics for different products; inexpensive or replaceable materials for low cost impact on actual product marketing costs; and a structurally sound display for use in retail and other environments.

It is an object of the present invention to provide an aesthetic display system.

A further object of the present invention is to provide an inexpensive display assembly.

A still further object of the present invention is directed to provide a display assembly that provides for an efficient assembly without requiring tools.

Yet another object of the present invention is to provide a display assembly that is structurally sound without requiring adhesives or additional fasteners or connectors.

A still further object of the present invention is to provide a lightweight compact display assembly.

Yet a further object of the present invention is to provide free standing display assembly.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
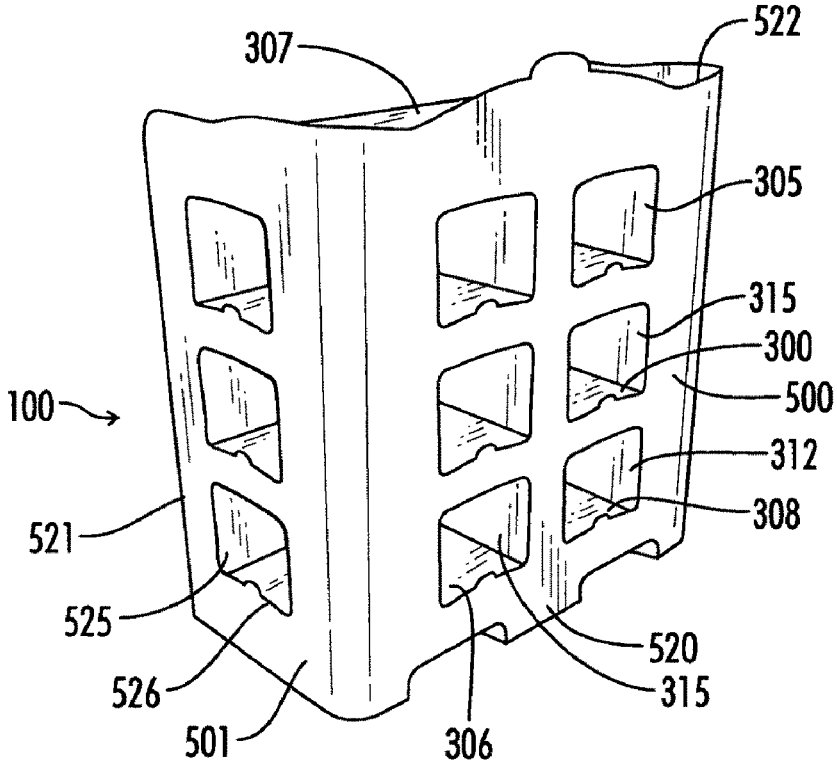
FIG. 1 is a perspective view of a first exemplary embodiment of the present invention.
Figure 2:
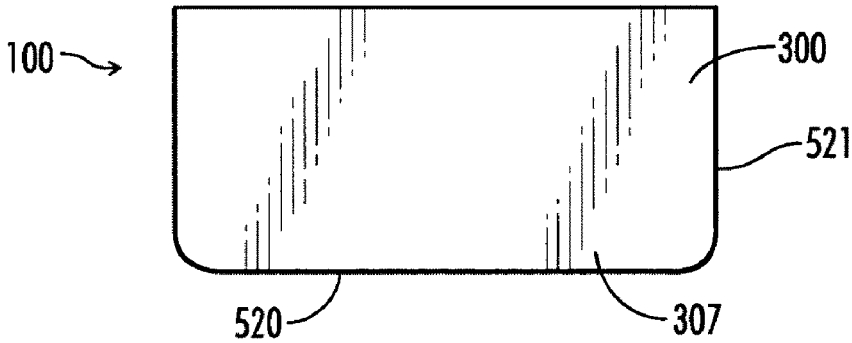
FIG. 2 is a top plan view of thereof.
Figure 3:
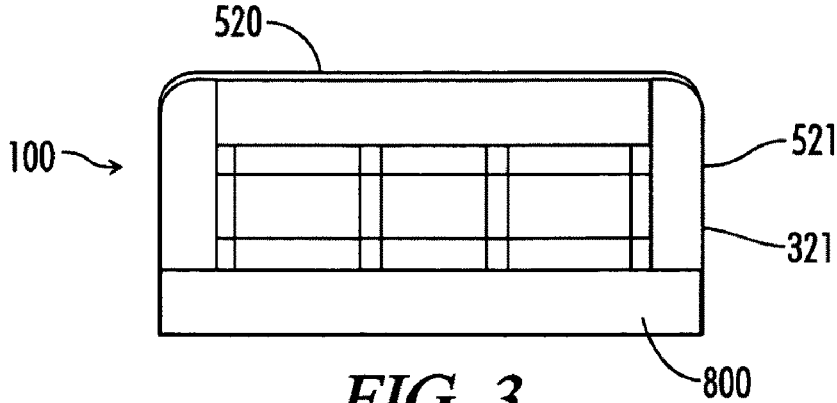
FIG. 3 is a bottom plan view thereof.
Figure 4:
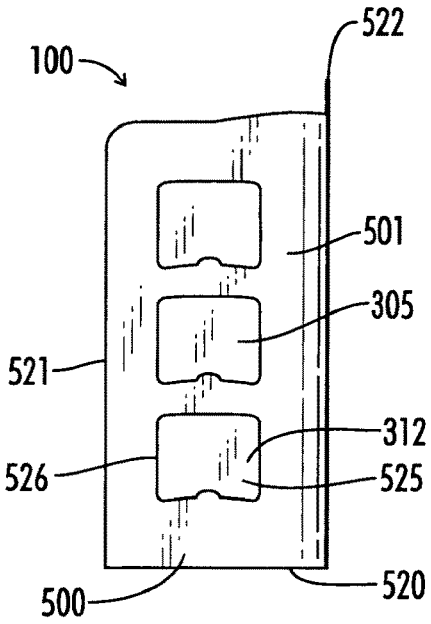
FIG. 4 is a left side elevational view thereof.
Figure 5:
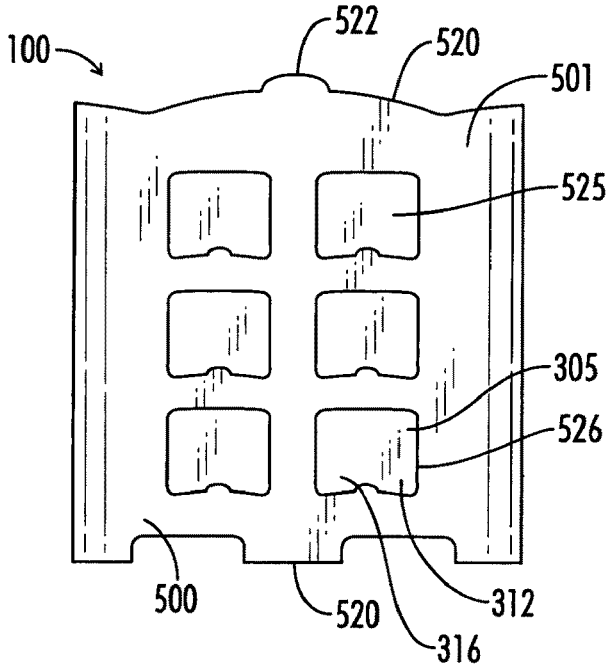
FIG. 5 is a front side elevational view thereof.
Figure 6:
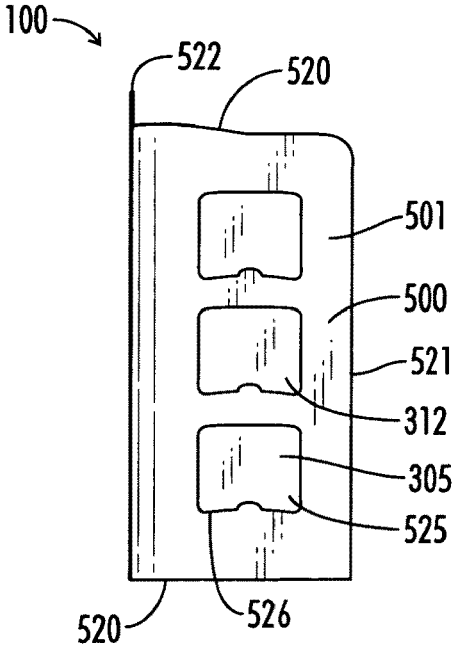
FIG. 6 is a right side elevational view thereof.
Figure 7:
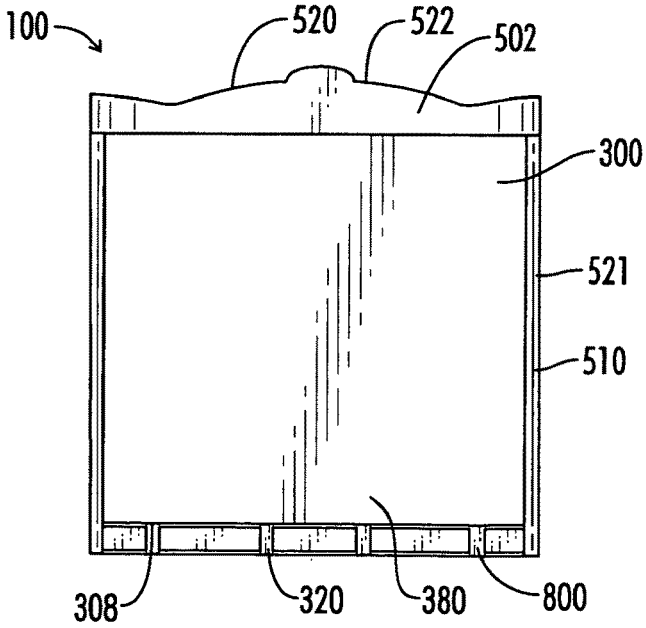
FIG. 7 is a back side elevational view thereof.

FIGS. 1-7, 11-17, 20-26, and 29-42 of the drawings show completed versions of various forms of the display assembly 100. FIGS. 8-10, 18-19, and 27-28 show an exploded view of one embodiment of the display assembly 100 showing the components of an interior frame 300, planar sheet 500, and attachment panel 700.

The display assembly 100 is constructed to display a variety of items, including beverage containers, digital video containers, music recording containers, and other irregular sized containers. As shown in FIGS. 1-10, the display 100 consists of an interior frame 300, which may be composed of a paperboard material, corrugated material, or thin walled plastic, a planar sheet 500, which may be composed of a paperboard material, corrugated material, or thin walled plastic, and an attachment panel 700, which may be composed of a paperboard, corrugated material or a thin walled plastic.

Figure 10:
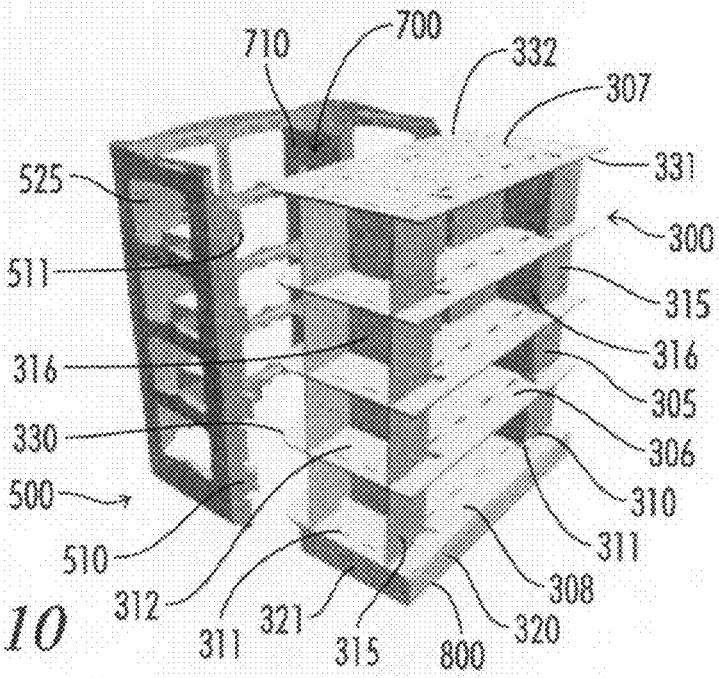
FIG. 10 is an exploded view thereof.
Figure 11:
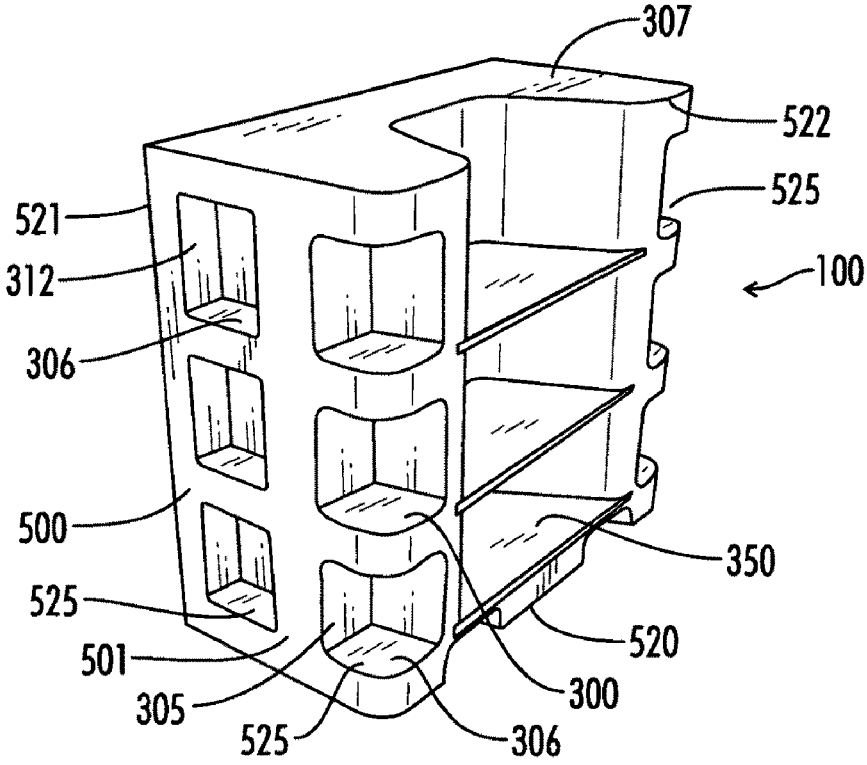
FIG. 11 is a perspective view of a second exemplary embodiment of the present invention.
Figure 12:
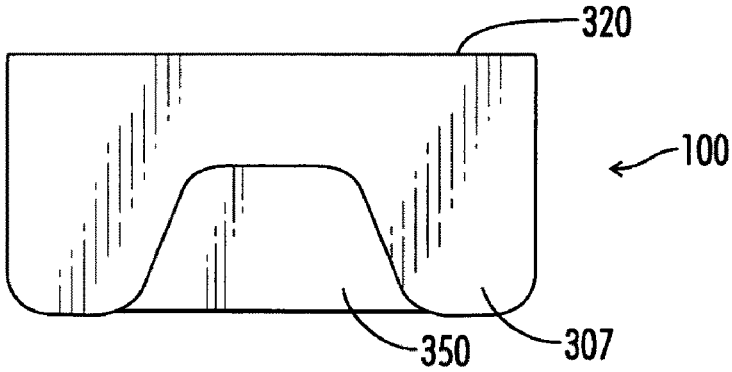
FIG. 12 is a top plan view of thereof.
Figure 13:
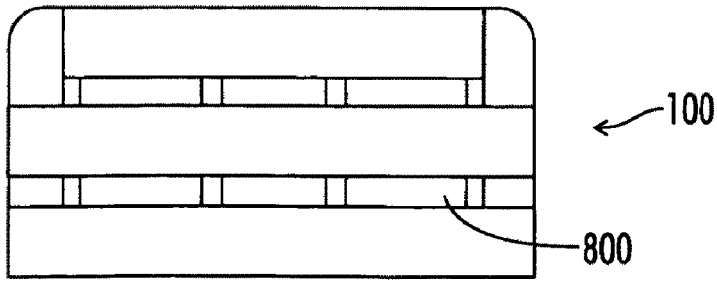
FIG. 13 is a bottom plan view thereof.
Figure 14:
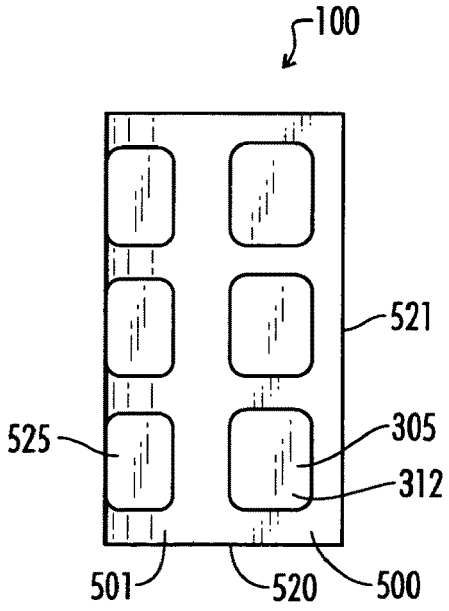
FIG. 14 is a left side elevational view thereof.
Figure 15:
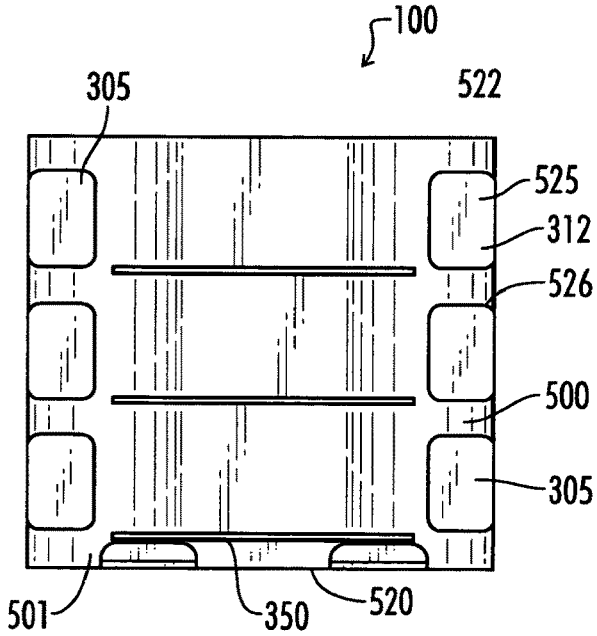
FIG. 15 is a front side elevational view thereof.
Figure 16:
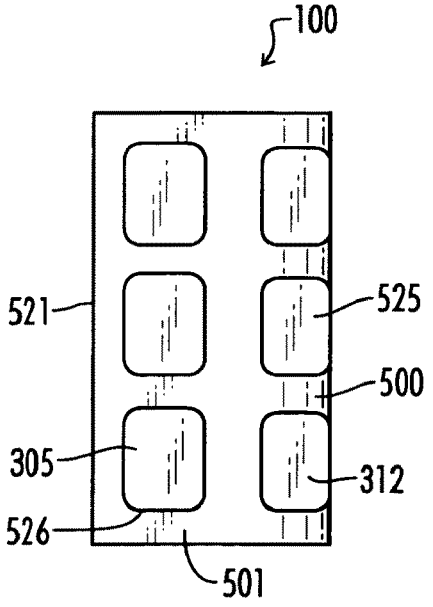
FIG. 16 is a right side elevational view thereof.
Figure 17:
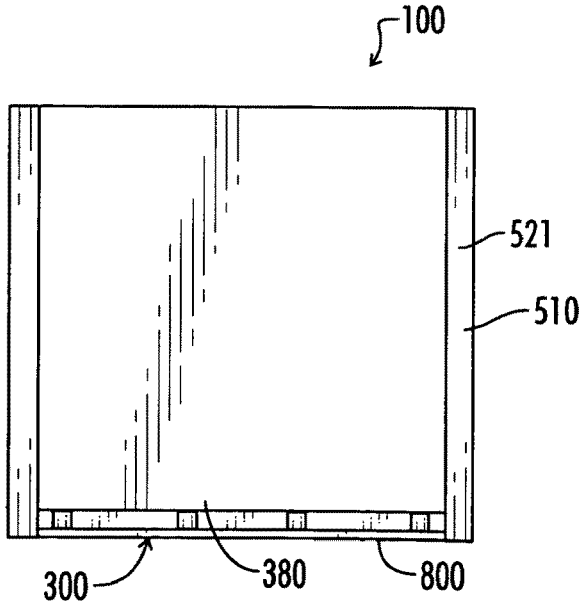
FIG. 17 is a back side elevational view thereof.

The interior frame 300 of the first embodiment is composed of vertical dividers 305 and horizontal dividers 306 that are interlocking to form a rectangular frame. As shown in FIG. 10, the interior frame has two longer sides 320 and two shorter sides 321. For purposes of describing positioning of the elements of the interior frame 300 and the attachment panel 700, the long sides 320 will be used as reference. The uppermost horizontal divider 306 functions as the top panel 307 of the frame and the lowermost horizontal divider 306 functions as a base panel 308 which may be attached to a pallet 800. Each horizontal divider 306 is parallel to the other dividers 306 has a multitude of slots 310, adapted to accommodate the placement of the vertical dividers 305 within the slots 310, and a multitude of slots 311, adapted to accommodate the attachment of the planar sheet 500. As shown, the present embodiment includes five horizontal dividers 306 forming four shelving spaces 312. The vertical dividers 305 are inserted through the horizontal dividers 306 parallel and perpendicular to the long side 320 of the frame 300. The vertical dividers may utilize friction, notches, tabs or other similar devices to maintain the position of the horizontal dividers 306 along the vertical length of the dividers 305. In this way, two parallel vertical dividers 315 abutted by a perpendicular vertical divider 316 form three sides of a storage space 312. In this manner, multiple storage spaces 312 are defined by a top and bottom horizontal dividers 306, a back vertical divider, and two side vertical dividers along the length 320 of the frame 300. Each horizontal divider 306 has an edge 330 running the perimeter of the frame. The edge 330 is characterized by a variation of straight portions 331 and arcuate portions 332. The arcuate portions allow for the exterior of the frame to have a curved element which in turn creates a curve for the exterior shell when the planar sheet 500 is installed.

The planar sheet 500 is a flat paper product adapted to be curved and bent around the interior frame 300. In the preferred embodiment, the paper composition of the planar sheet 500 is suitable for high quality printing of a graphic element. In the first embodiment, the planar sheet is rectangular with a front side 501, a back side 502, two long edges 520 and two short edges 521 which have an attachment strip 510. For purposes of describing positioning of the elements of the planar sheet 500, the long edges 520 will be used as reference. In the preferred embodiment, the front side 501 will include a graphic element, such as advertising. Additionally, the top long edge 522 can characterized by marketing shape, such as a logo or outline of a person, so that the top edge 522 extends substantially higher than the interior frame 300 when the planar sheet is installed.

Figure 8:
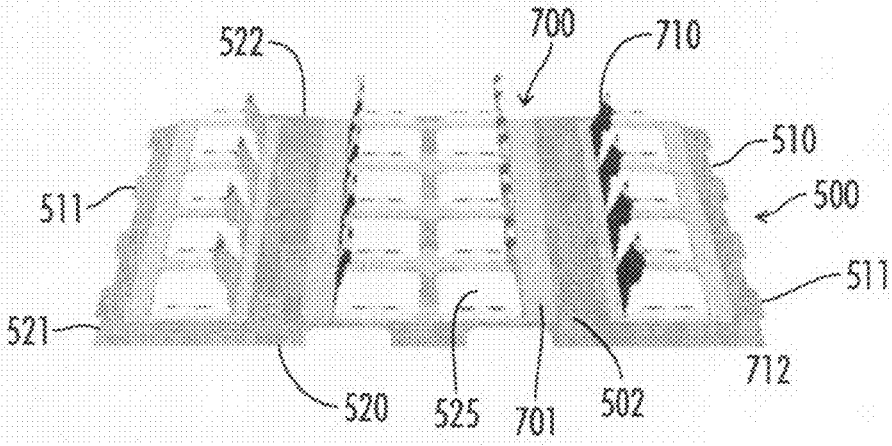
FIG. 8 is a perspective view of the back side of the planar sheet therefor.
Figure 9:
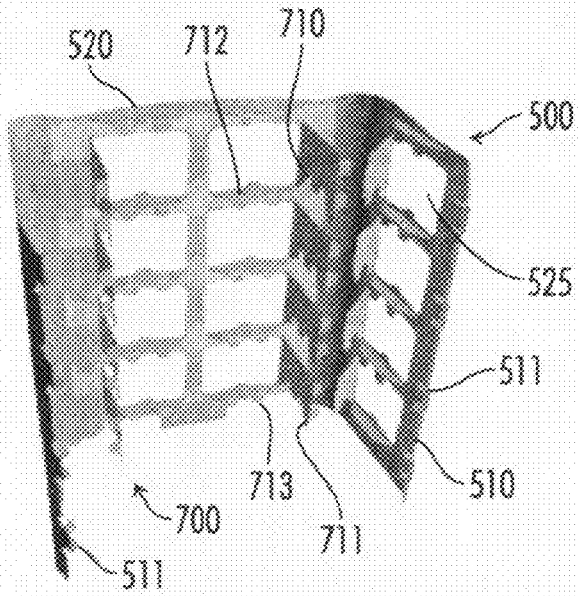
FIG. 9 is a perspective view thereof.

The planar sheet 500 is secured to the interior frame 300 through use of an attachment strip 510 with multiple tabs 511. In its installed position, the planar sheet 500 is wrapped around the interior frame 300 abutting the exterior edge 330 of the horizontal dividers 306. In this manner, the planar sheet 500 conforms to the shape of the horizontal dividers 306 to form an arcuate exterior shell. The attachment strip 510 includes multiple tabs 511 on each short side 521 of the planar sheet which can secure to the interior frame 300 or to a backing sheet 380 attached to the interior frame 300. The tabs 511 as shown in FIG. 8 are positioned to correspond with the attachment slots on the interior frame 300 and feature a rectangular portion with two flaps foldably connected to the portion, allowing for the flaps to be moved to insert into the frame 300. The planar sheet 500 may be attached by a folded tab, adhesive, or a hook and loop type system, however, in the preferred embodiment, the removable nature of multiple tabs 511 allows for replacement of the planar sheet 500 during various advertising campaigns, thereby allowing for continual use of the interior frame 300.

The planar sheet 500 includes multiple apertures 525 along the length 520 of the sheet 500. The apertures 525 may be cut into the sheet 500 in any way typical with the industry, but the preferred embodiment provides die-cut apertures 525 to provide a clean edge 526 around the aperture 525. The apertures 525 can be cut into any shape. The placement of the apertures 525 coincides in proximity with the storage spaces 312 of the interior frame, thereby allowing access through the planar sheet 500 to the goods located in the storage space 312.

The attachment panel 700 may be a separate piece of paperboard product or incorporated into the planar sheet 500 itself. The attachment panel, in the preferred embodiment is attached by adhesive to the planar sheet 500 in a position coinciding with the straight portion of the horizontal dividers 306 when the planar sheet 500 is installed. In this manner, the attachment panel 700 reinforces the planar sheet 500 and prevents buckling, rippling, or other unaesthetically pleasing problems. A problem in providing a planar sheet 500 which has straight portions and arcuate portions is that the sheet tends to buckle. Reinforcement along the straight portions which forces the sheet 500 to press closely to the interior structure 300 tightens the connection between the sheet 500 and structure 300, thereby reducing buckling and other problems. Without the attachment panel 700, the sheet 500 cannot effectively connect to the frame 300.

In the present embodiment, the placement of the attachment panel 700 coincides with the placement of the multiple apertures 525, which are located on the flat portion of the exterior shell. The attachment panel is composed of a margin 701 of material, which surrounds the apertures 525 and reinforces the straight portion of the exterior shell, a side flap 710 foldably joined to the margin 701 next to each aperture 525, and a base flap 712 foldably joined to the margin 701 next to each aperture 525. The side flap 710 in its undeployed state is parallel to the face of the planar sheet 500 and is adapted to foldably move to its deployed state connected to the interior frame perpendicular to the long side of the interior frame 320. The side flap 710 has multiple tabs 711 which insert into the frame 300. The base flap 712 in its undeployed state is parallel to the face of the planar sheet 500 and is adapted to foldably move to its deployed state connected to the interior frame 300 parallel to the horizontal dividers 306 of the frame 300. The base flap 712 has multiple tabs 713 which are parallel to the long side 320 of the interior frame and insert into the frame 300.

As shown in FIGS. 11-19, the display 100 consists of an interior frame 300, which may be composed of a paperboard material, corrugated material, or thin walled plastic, a planar sheet 500, which may be composed of a paperboard material, corrugated material, or thin walled plastic, and an attachment panel 700, which may be composed of a paperboard, corrugated material or a thin walled plastic.

Figure 19:
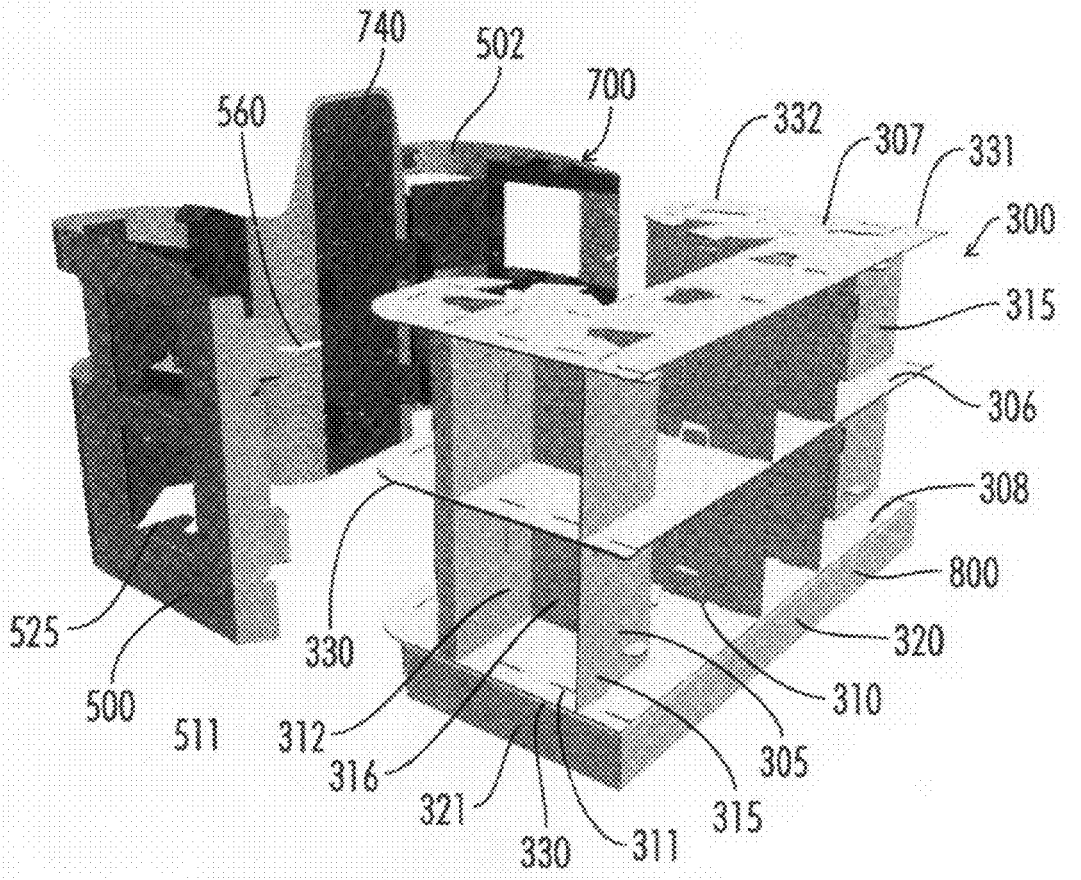
FIG. 19 is an exploded view thereof.
Figure 20:
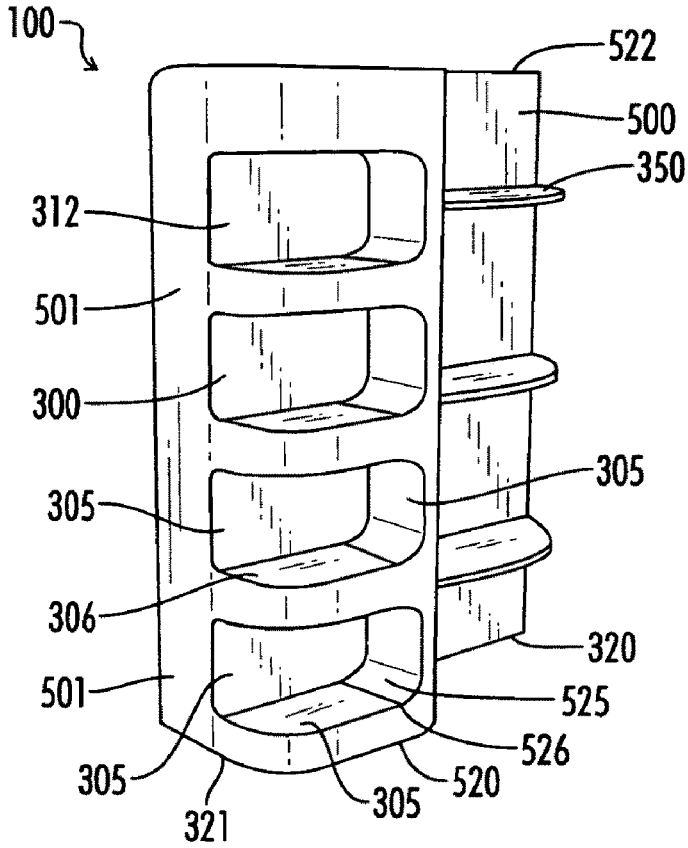
FIG. 20 is a perspective view of a third exemplary embodiment of the present invention.
Figure 21:
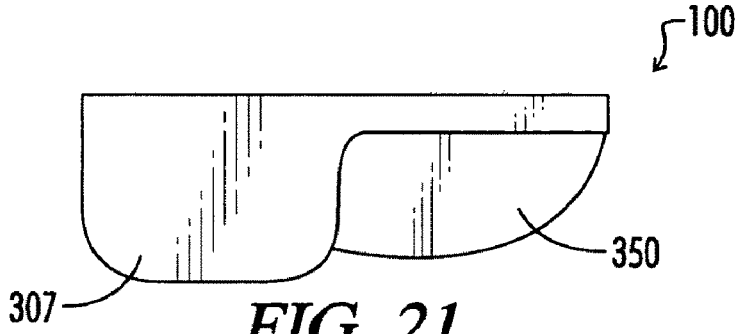
FIG. 21 is a top plan view of thereof.
Figure 22:
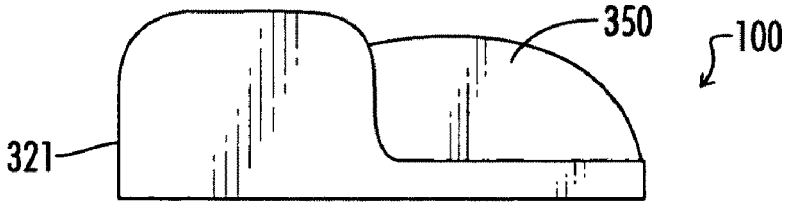
FIG. 22 is a bottom plan view thereof.
Figure 23:
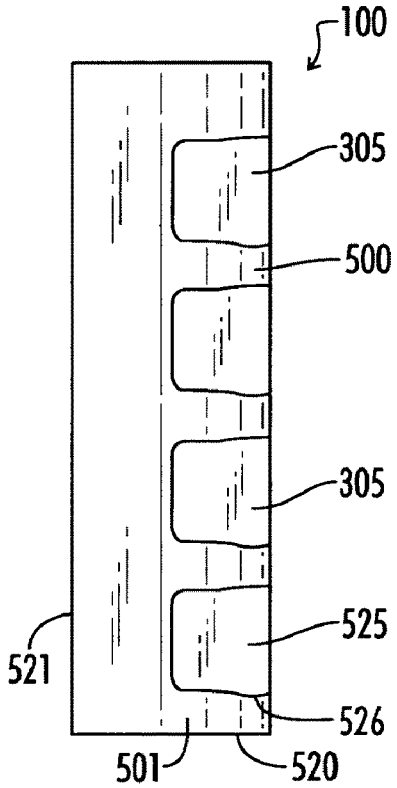
FIG. 23 is a left side elevational view thereof.
Figure 24:
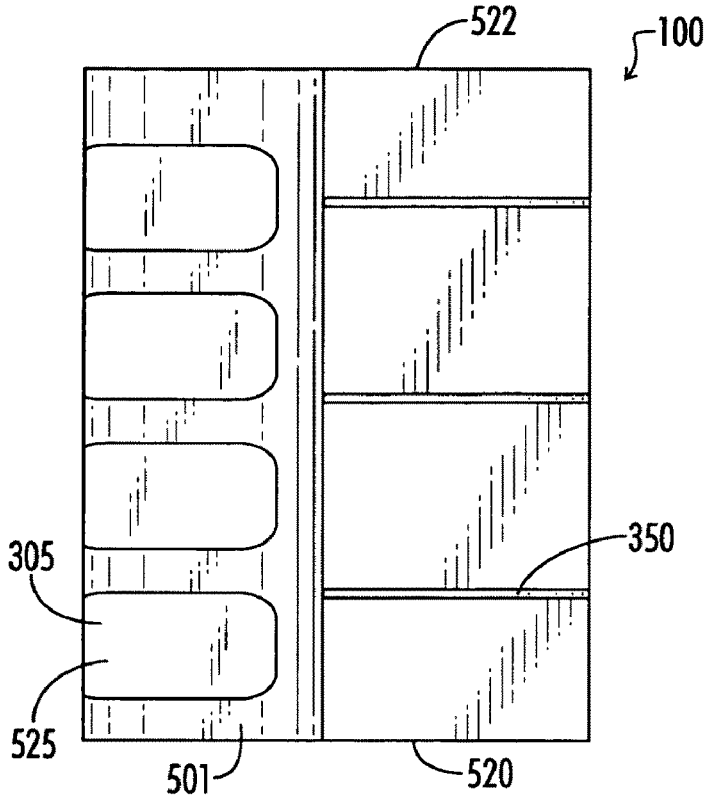
FIG. 24 is a front side elevational view thereof.
Figure 25:
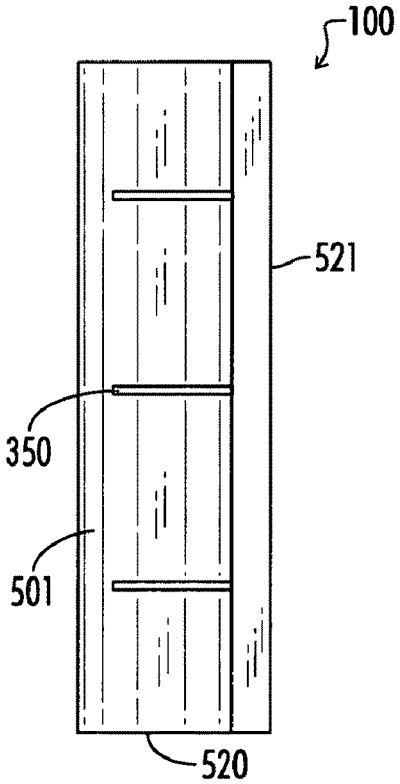
FIG. 25 is a right side elevational view thereof.
Figure 26:
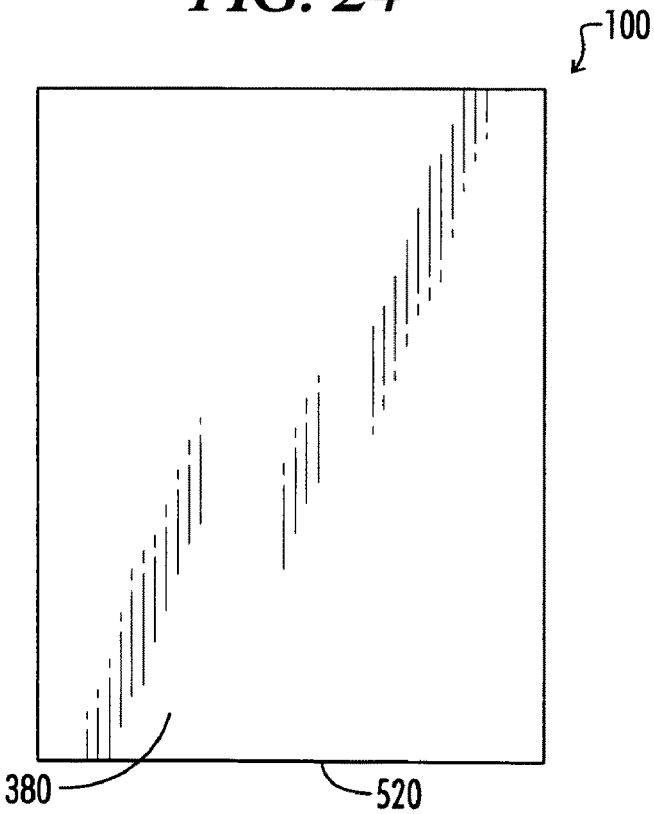
FIG. 26 is a back side elevational view thereof.

The interior frame 300 of the second embodiment is composed of vertical dividers 305 and horizontal dividers 306 that are interlocking to form a horseshoe-shaped frame. As shown in FIG. 19, the interior frame has two longer sides 320 and two shorter sides 321. For purposes of describing positioning of the elements of the interior frame 300 and the attachment panel 700, the long sides 320 will be used as reference. The uppermost horizontal divider 306 functions as the top panel 307 of the frame and the lowermost horizontal divider 306 functions as a base panel 308 which may be attached to a pallet 800. Each horizontal divider 306 is parallel to the other dividers 306 has a multitude of slots 310, adapted to accommodate the placement of the vertical dividers 305 within the slots 310, and a multitude of slots 311, adapted to accommodate the attachment of the planar sheet 500. As shown, the present embodiment includes three or four horizontal dividers 306 forming two or three shelving spaces 312. The vertical dividers 305 are inserted through the horizontal dividers 306 parallel and perpendicular to the long side 320 of the frame 300. The vertical dividers may utilize friction, notches, tabs or other similar devices to maintain the position of the horizontal dividers 306 along the vertical length of the dividers 305. In this way, two parallel vertical dividers 315 abutted by a perpendicular vertical divider 316 form three sides of a storage space 312. In this manner, multiple storage spaces 312 are defined by a top and bottom horizontal dividers 306, a back vertical divider, and two side vertical dividers along the length 320 of the frame 300. Each horizontal divider 306 has an edge 330 running the perimeter of the frame. The edge 330 is characterized by a variation of straight portions 331 and arcuate portions 332. The arcuate portions allow for the exterior of the frame to have a curved element which in turn creates a curve for the exterior shell when the planar sheet 500 is installed.

The second embodiment utilizes a horseshoe-shape design which allows for additional shelving 350 on the front side of the planar sheet 500 and exterior to the interior frame 300. The interior frame 300 has attachment ports (not shown) which allow for the exterior shelves 350 to connect to the interior frame 300 to provide stability.

The planar sheet 500 is a flat paper product adapted to be curved and bent around the interior frame 300. In the preferred embodiment, the paper composition of the planar sheet 500 is suitable for high quality printing of a graphic element. In the second embodiment, the planar sheet is rectangular with a front side 501, a back side 502, two long edges 520 and two short edges 521 which have an attachment strip 510. For purposes of describing positioning of the elements of the planar sheet 500 and the attachment panel 700, the long edges 520 will be used as reference. In the preferred embodiment, the front side 501 will include a graphic element, such as advertising. Additionally, in this embodiment, the top long edge 522 is characterized by marketing shape, such as a logo or outline of a person, so that the top edge 522 extends substantially higher than the interior frame 300 when the planar sheet is installed.

Figure 18:
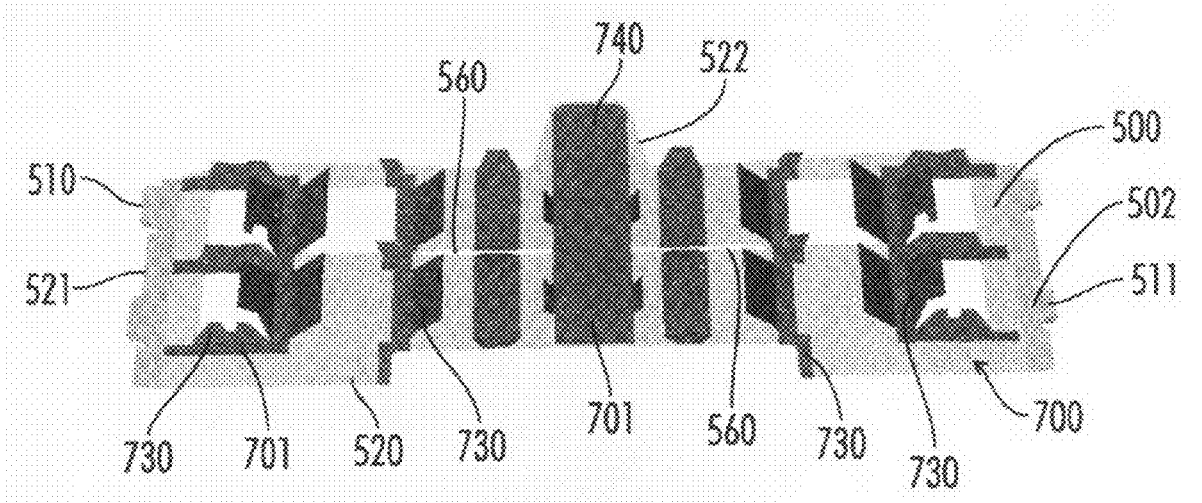
FIG. 18 is a perspective view of the back side of the planar sheet therefor.

The planar sheet 500 is secured to the interior frame 300 through use of an attachment strip 510 with multiple tabs 511. In its installed position, the planar sheet 500 is wrapped around the interior frame 300 abutting the exterior edge 330 of the horizontal dividers 306. In this manner, the planar sheet 500 conforms to the shape of the horizontal dividers 306 to form an arcuate exterior shell. The attachment strip 510 includes multiple tabs 511 on each short side 521 of the planar sheet which can secure to the interior frame 300 or to a backing sheet 380 attached to the interior frame 300. The tabs 511 as shown in FIG. 18 are positioned to correspond with the attachment slots on the interior frame 300 and feature a rectangular portion with two flaps foldably connected to the portion, allowing for the flaps to be moved to insert into the frame 300. The planar sheet 500 may be attached by a folded tab, adhesive, or a hook and loop type system, however, in the preferred embodiment, the removable nature of multiple tabs 511 allows for replacement of the planar sheet 500 during various advertising campaigns, thereby allowing for continual use of the interior frame 300.

The planar sheet 500 includes multiple apertures 525 along the length 521 of the sheet 500. The apertures 525 may be cut into the sheet 500 in any way typical with the industry, but the preferred embodiment provides die-cut apertures 525 to provide a clean edge 526 around the aperture 525. The apertures 525 can be cut into any shape. The placement of the apertures 525 coincides in proximity with the storage spaces 312 of the interior frame, thereby allowing access through the planar sheet 500 to the goods located in the storage space 312. In this embodiment, the planar sheet 500 also includes apertures 560 allowing for the insertion of the exterior shelving 350. In this manner, the apertures 560 provide access for the shelving 350 to the interior frame 300 and provide a seamless appearance to the viewer for the graphic element around the shelving 350.

In the present embodiment, the placement of the attachment panel 700 coincides with the placement of the multiple apertures 525 and along the straight portions of the horseshoe shape. The attachment panel of this embodiment is similar in scope to the attachment panel of the fourth and fifth embodiment. In this embodiment, the attachment panel 700 differs along the length 520 of the sheet 500. The four attachment panels 730 closest to the edges 521 are composed of a margin 701 of material along the which abut the edges of the apertures 525 and reinforces the straight portion of the exterior shell, a side flap 710 foldably joined to each side of the margin 701, and a base flap 712 foldably joined to the margin 701 next to each aperture 525. The three attachment panels 740 closest to the inside of the sheet 500 are composed of a margin 701 of material along the which abut the edges of the apertures 525 and a side flap 710 foldably joined to each side of the margin 701. The side flap 710 in its undeployed state is parallel to the face of the planar sheet 500 and is adapted to foldably move to its deployed state connected to the interior frame perpendicular to the long side of the interior frame 320. The side flap 710 has multiple tabs 711 which insert into the frame 300. The base flap 712 in its undeployed state is parallel to the face of the planar sheet 500 and is adapted to foldably move to its deployed state connected to the interior frame 300 parallel to the horizontal dividers 306 of the frame 300. The base flap 712 has multiple tabs 713 which are parallel to the long side 320 of the interior frame and insert into the frame 300.

As shown in FIGS. 20-28, the display 100 consists of an interior frame 300, which may be composed of a paperboard material, corrugated material, or thin walled plastic, a planar sheet 500, which may be composed of a paperboard material, corrugated material, or thin walled plastic, and an attachment panel 700, which may be composed of a paperboard, corrugated material or a thin walled plastic.

Figure 28:
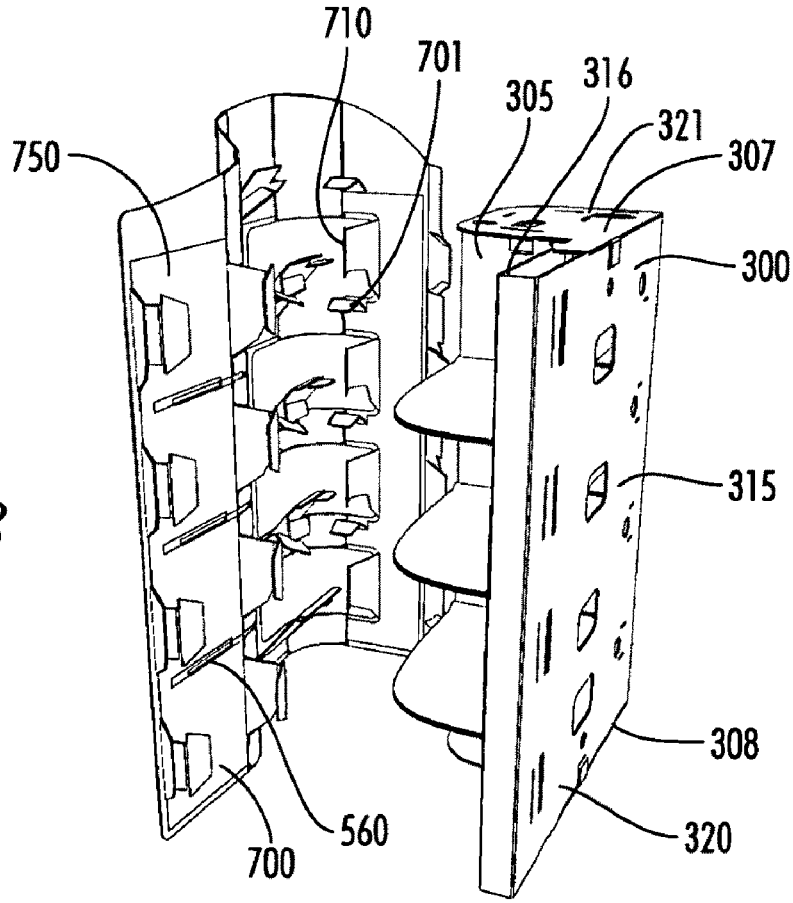
FIG. 28 is an exploded view thereof.
Figure 29:
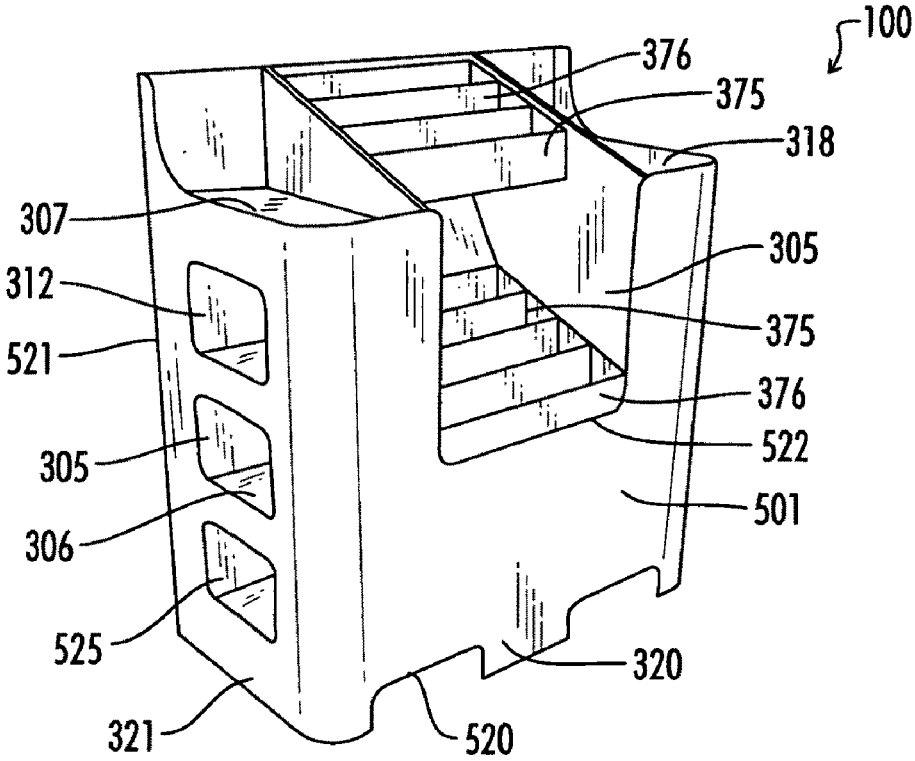
FIG. 29 is a perspective view of a fourth exemplary embodiment of the present invention.
Figure 30:
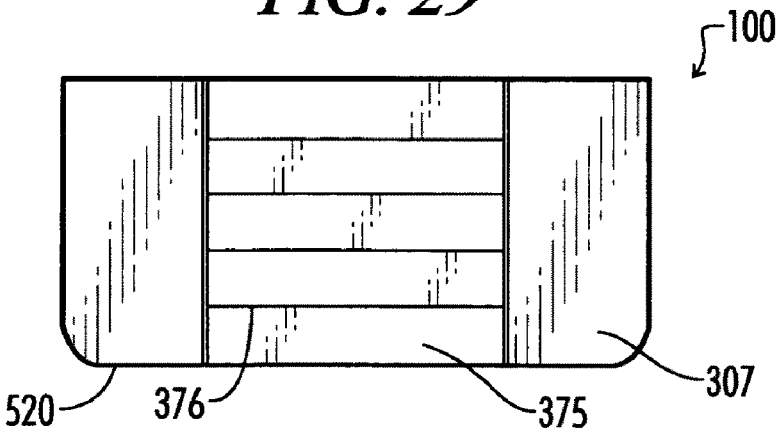
FIG. 30 is a top plan view of thereof.
Figure 31:
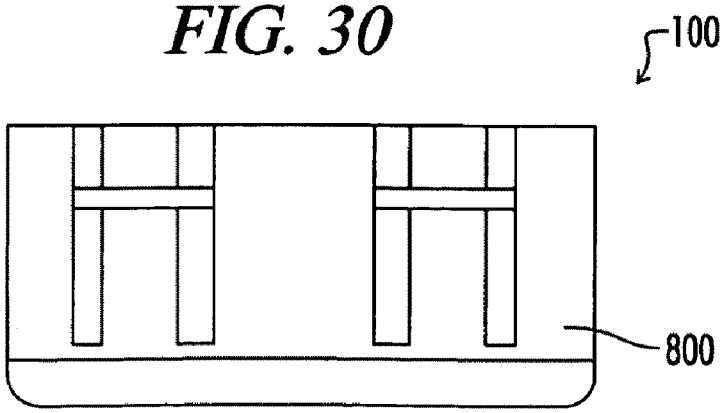
FIG. 31 is a bottom plan view thereof.
Figure 32:
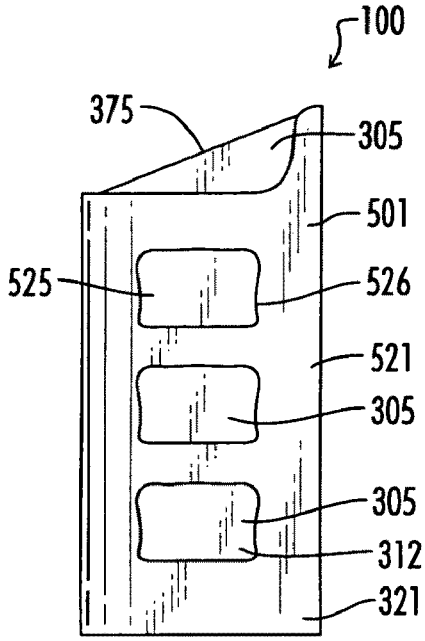
FIG. 32 is a left side elevational view thereof.
Figure 33:
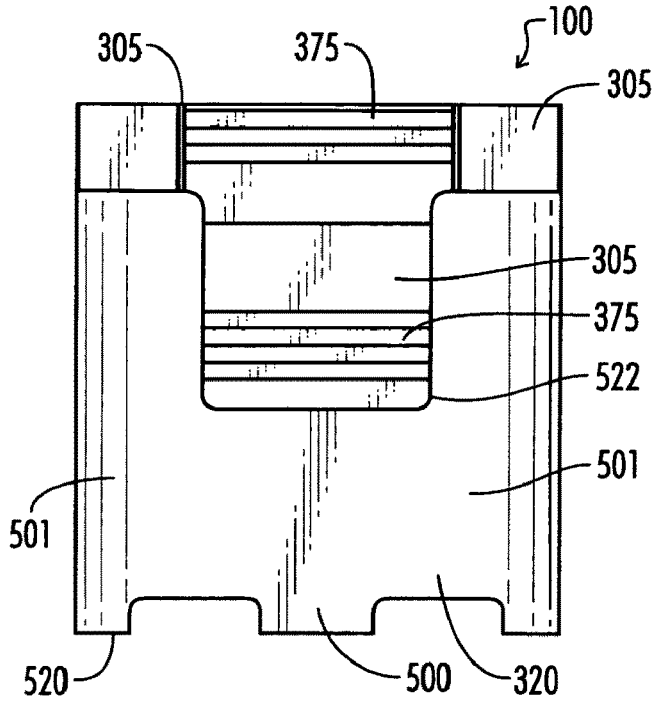
FIG. 33 is a front side elevational view thereof.
Figure 34:
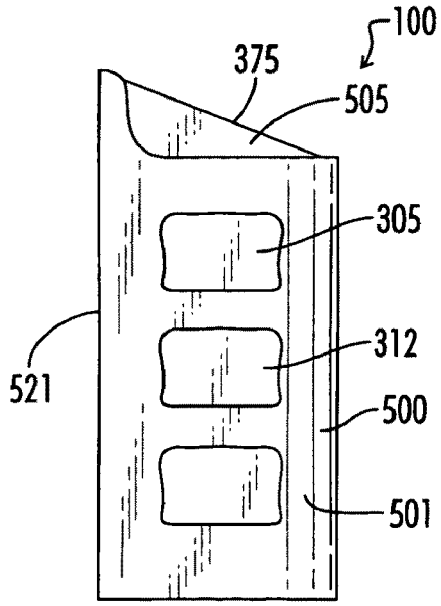
FIG. 34 is a right side elevational view thereof.
Figure 35:
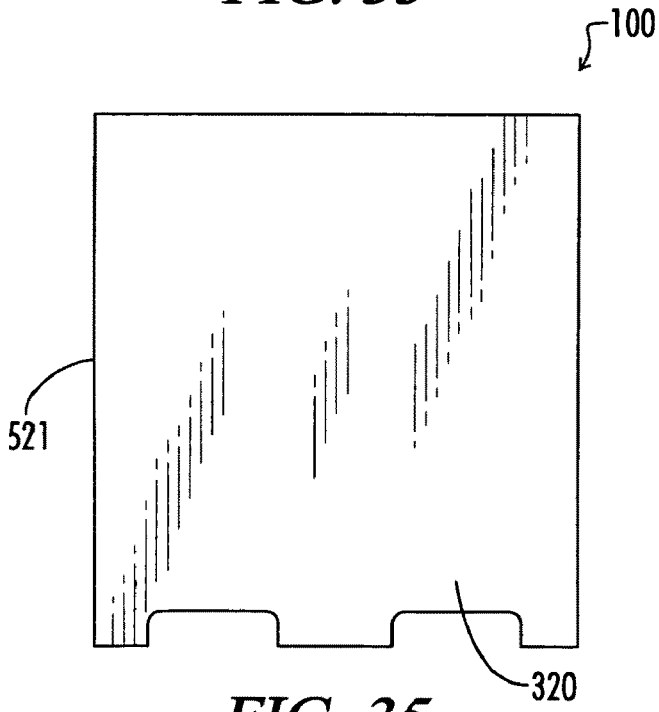
FIG. 35 is a back side elevational view thereof.
Figure 36:
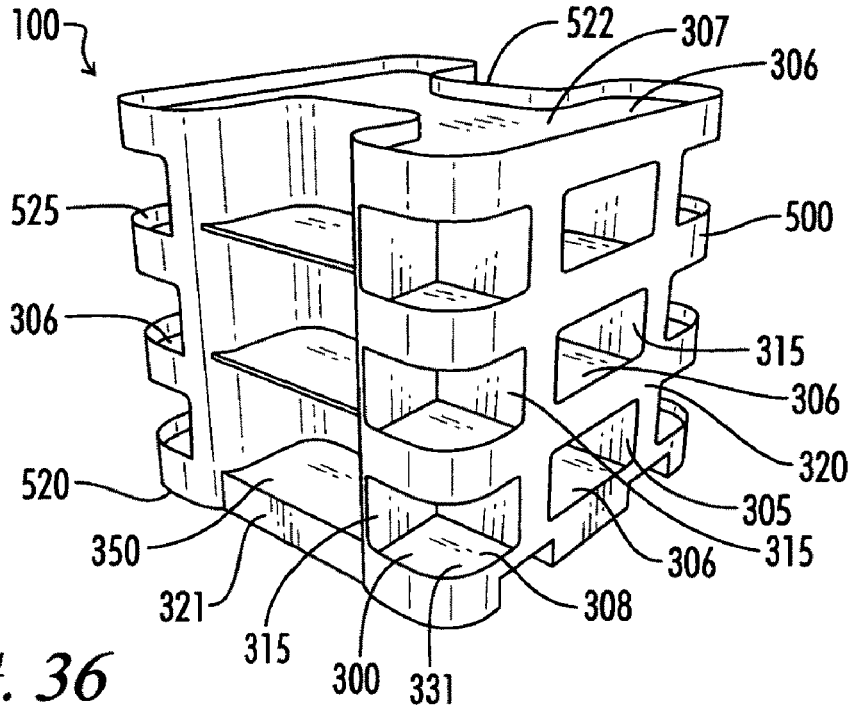
FIG. 36 is a perspective view of a fifth exemplary embodiment of the present invention.
Figure 37:
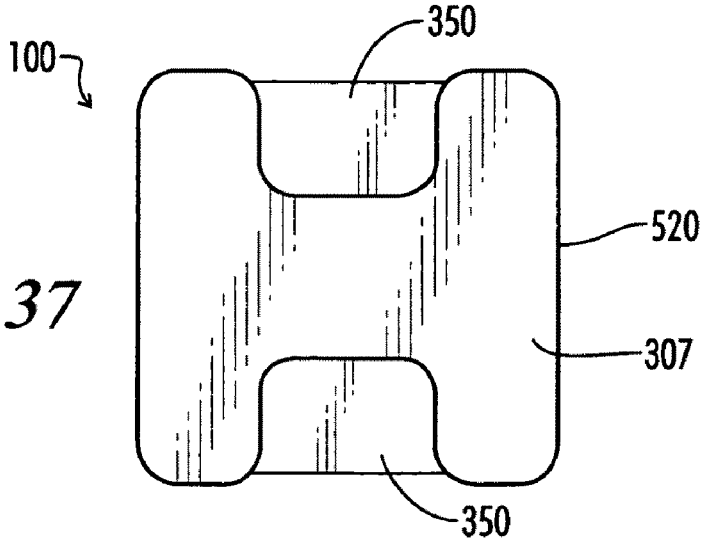
FIG. 37 is a top plan view of thereof.
Figure 38:
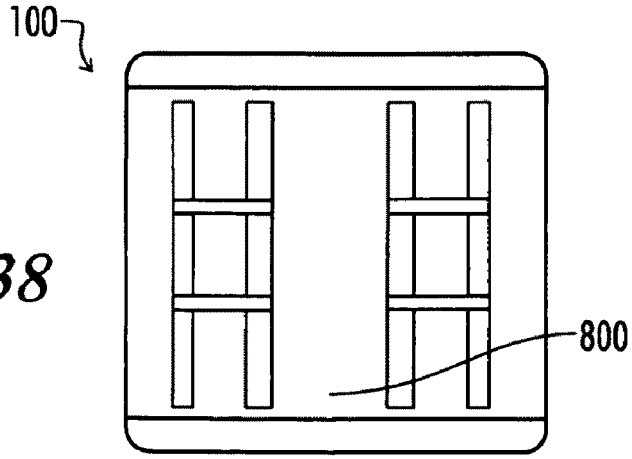
FIG. 38 is a bottom plan view thereof.
Figure 39:
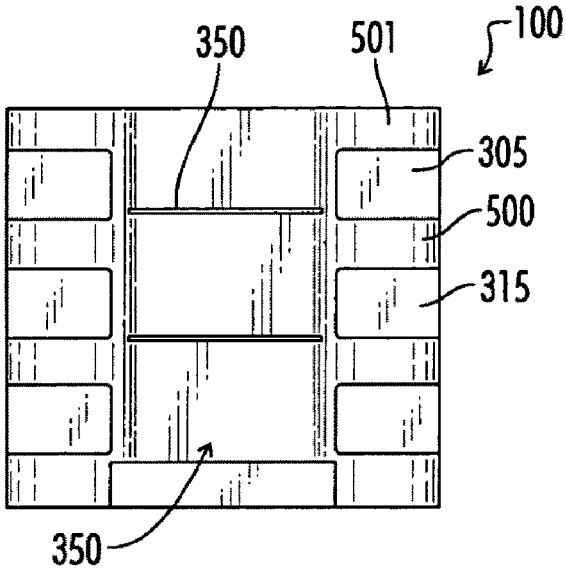
FIG. 39 is a left side elevational view thereof.
Figure 40:
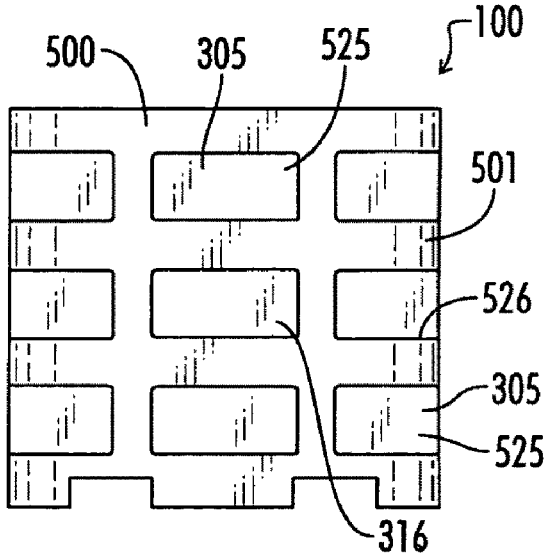
FIG. 40 is a front side elevational view thereof.
Figure 41:
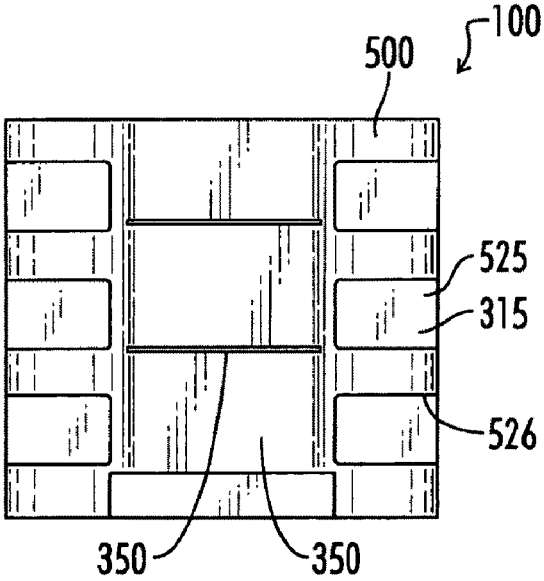
FIG. 41 is a right side elevational view thereof.
Figure 42:
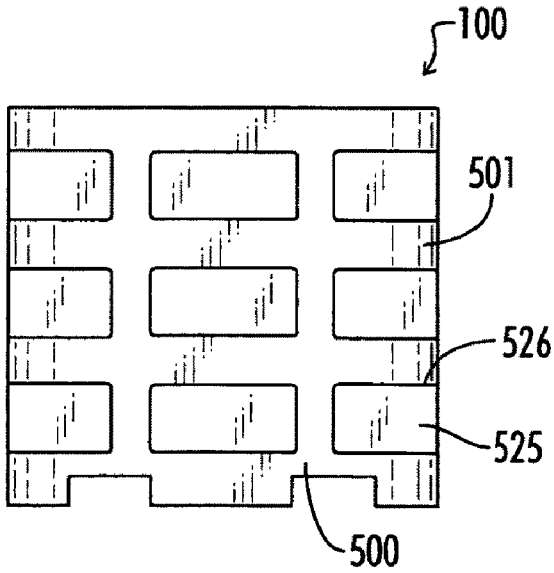
FIG. 42 is a back side elevational view thereof.

The interior frame 300 of the third embodiment is composed of vertical dividers 305 and horizontal dividers 306 that are interlocking to form a L-shaped frame. As shown in FIG. 28, the interior frame has a longer leg 320 and short leg 321. For purposes of describing positioning of the elements of the interior frame 300 and the attachment panel 700, the long leg 320 will be used as reference. The uppermost horizontal divider 306 functions as the top panel 307 of the frame and the lowermost horizontal divider 306 functions as a base panel 308 which may be attached to a pallet (not shown). Each horizontal divider 306 is parallel to the other dividers 306 has a multitude of slots 310, adapted to accommodate the placement of the vertical dividers 305 within the slots 310, and a multitude of slots 311, adapted to accommodate the attachment of the planar sheet 500. As shown, the present embodiment includes five horizontal dividers 306 forming four shelving spaces 312. The vertical dividers 305 are inserted through the horizontal dividers 306 parallel and perpendicular to the long side 320 of the frame 300. The vertical dividers may utilize friction, notches, tabs or other similar devices to maintain the position of the horizontal dividers 306 along the vertical length of the dividers 305. In this way, two parallel vertical dividers 315 abutted by a perpendicular vertical divider 316 form three sides of a storage space 312. In this manner, multiple storage spaces 312 are defined by a top and bottom horizontal dividers 306, a back vertical divider, and two side vertical dividers along the length 320 of the frame 300. Each horizontal divider 306 has an edge 330 running the perimeter of the frame. The edge 330 is characterized by a variation of straight portions 331 and arcuate portions 332. The arcuate portions allow for the exterior of the frame to have a curved element which in turn creates a curve for the exterior shell when the planar sheet 500 is installed.

The third embodiment utilizes an L-shape design which allows for additional shelving 350 along the length of the long leg of the L in front of the planar sheet 500 and exterior to the interior frame 300. The interior frame 300 has attachment ports (not shown) which allow for the exterior shelves 350 to connect to the interior frame 300 to provide stability.

The planar sheet 500 is a flat paper product adapted to be curved and bent around the interior frame 300. In the preferred embodiment, the paper composition of the planar sheet 500 is suitable for high quality printing of a graphic element. In the third embodiment, the planar sheet is rectangular with a front side 501, a back side 502, two long edges 520 and two short edges 521, one of which has an attachment strip 510. For purposes of describing positioning of the elements of the planar sheet 500 and the attachment panel 700, the long edges 520 will be used as reference. In the preferred embodiment, the front side 501 will include a graphic element, such as advertising. Additionally, the top long edge 522 may be characterized by marketing shape, such as a logo or outline of a person, so that the top edge 522 extends substantially higher than the interior frame 300 when the planar sheet is installed.

Figure 27:
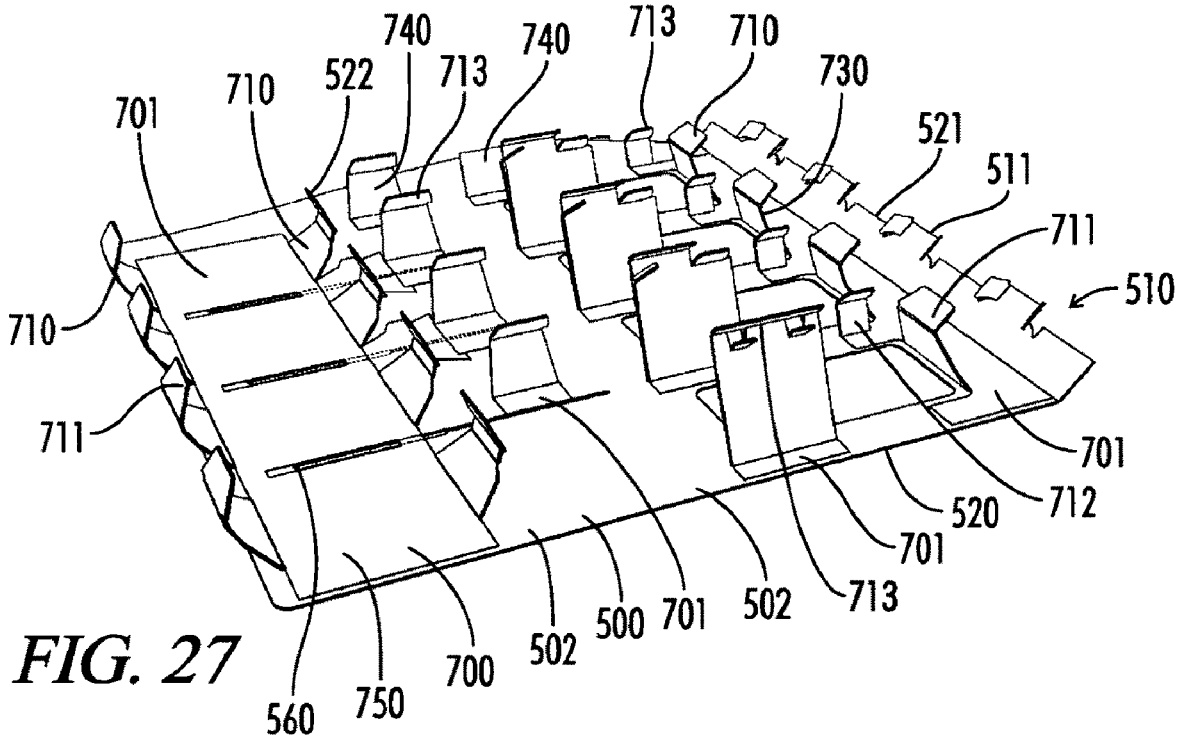
FIG. 27 is a perspective view of the back side of the planar sheet therefor.

The planar sheet 500 is secured to the interior frame 300 through use of an attachment strip 510 with multiple tabs 511. In its installed position, the planar sheet 500 is wrapped around the interior frame 300 abutting the exterior edge 330 of the horizontal dividers 306. In this manner, the planar sheet 500 conforms to the shape of the horizontal dividers 306 to form an arcuate exterior shell. The attachment strip 510 includes multiple tabs 511 on one short side 521 of the planar sheet which can secure to the interior frame 300 or to a backing sheet 380 attached to the interior frame 300. The tabs 511 as shown in FIG. 27 are positioned to correspond with the attachment slots on the interior frame 300 and feature a rectangular portion with two flaps foldably connected to the portion, allowing for the flaps to be moved to insert into the frame 300. The planar sheet 500 may be attached by a folded tab, adhesive, or a hook and loop type system, however, in the preferred embodiment, the removable nature of multiple tabs 511 allows for replacement of the planar sheet 500 during various advertising campaigns, thereby allowing for continual use of the interior frame 300.

The planar sheet 500 includes multiple apertures 525 along the length 520 of the sheet 500. The apertures 525 may be cut into the sheet 500 in any way typical with the industry, but the preferred embodiment provides die-cut apertures 525 to provide a clean edge 526 around the aperture 525. The apertures 525 can be cut into any shape. The placement of the apertures 525 coincides in proximity with the storage spaces 312 of the interior frame, thereby allowing access through the planar sheet 500 to the goods located in the storage space 312. In this embodiment, the planar sheet 500 also includes apertures 560 allowing for the insertion of the exterior shelving 350. In this manner, the apertures 560 provide access for the shelving 350 to the interior frame 300 and provide a seamless appearance to the viewer for the graphic element around the shelving 350.

In the present embodiment, the placement of the attachment panel 700 coincides with the placement of the multiple apertures 525 and along the straight portions of the longer leg of the L-shape. In this embodiment, the attachment panel 700 differs along the length 520 of the L-shape. The attachment panels 730 flanking the outermost edges 521 of the apertures 525 is composed of a margin 701 of material along the which abut the of the apertures 525, a side flap 710 foldably joined to each side of the margin 701, and a base flap 712 foldably joined to the margin 701 next to each aperture 525. The two attachment panels 740 closest to the inside of the sheet 500 are composed of a margin 701 of material along the which abut the edges of the apertures 525 and a base flap 712 foldably joined to each side of the margin 701. The attachment panels 750 flanking the outermost edges 521 along the long leg of the L-shape is composed of a margin 701 of material along the which abut the of the apertures 525 and two side flaps 710 foldably joined to each side of the margin 701. The side flaps 710 in their undeployed state is parallel to the face of the planar sheet 500 and is adapted to foldably move to its deployed state connected to the interior frame perpendicular to the long side of the interior frame 320. The side flap 710 has multiple tabs 711 which insert into the frame 300. The base flaps 712 in their undeployed state is parallel to the face of the planar sheet 500 and is adapted to foldably move to its deployed state connected to the interior frame 300 parallel to the horizontal dividers 306 of the frame 300. The base flap 712 has multiple tabs 713 which are parallel to the long side 320 of the interior frame and insert into the frame 300.

As shown in FIGS. 29-35, the display 100 consists of an interior frame 300, which may be composed of a paperboard material, corrugated material, or thin walled plastic, a planar sheet 500, which may be composed of a paperboard material, corrugated material, or thin walled plastic, and an attachment panel 700, which may be composed of a paperboard, corrugated material or a thin walled plastic.

The interior frame 300 of the fourth embodiment is composed of vertical dividers 305 and horizontal dividers 306 that are interlocking to form a rectangular frame with a central tray 375. The interior frame has two longer sides 320 and two shorter sides 321. For purposes of describing positioning of the elements of the interior frame 300 and the attachment panel 700, the long side 320 will be used as reference. The uppermost horizontal divider 306 functions as the top panel 307 of the frame and the lowermost horizontal divider 306 functions as a base panel 308 which may be attached to a pallet 800. Each horizontal divider 306 is parallel to the other dividers 306 has a multitude of slots 310, adapted to accommodate the placement of the vertical dividers 305 within the slots 310, and a multitude of slots 311, adapted to accommodate the attachment of the planar sheet 500. As shown, the present embodiment includes four horizontal dividers 306 forming three internal shelving spaces 312 and an external top shelf 318. The vertical dividers 305 are inserted through the horizontal dividers 306 parallel and perpendicular to the long side 320 of the frame 300. The vertical dividers may utilize friction, notches, tabs or other similar devices to maintain the position of the horizontal dividers 306 along the vertical length of the dividers 305. In this way, two parallel vertical dividers 315 abutted by a perpendicular vertical divider 316 form three sides of a storage space 312. In this manner, multiple storage spaces 312 are defined by a top and bottom horizontal dividers 306, a back vertical divider, and two side vertical dividers along the length 320 of the frame 300. Each horizontal divider 306 has an edge 330 running the perimeter of the frame. The edge 330 is characterized by a variation of straight portions 331 and arcuate portions 332. The arcuate portions allow for the exterior of the frame to have a curved element which in turn creates a curve for the exterior shell when the planar sheet 500 is installed.

The fourth embodiment utilizes a rectangular design with a two central tray inserts cut into the planar sheet 500 and exterior to the interior frame 300. The interior frame 300 has attachment ports (not shown) which allow for the supporting the central trays 375 to connect to the interior frame 300 to provide stability. Each tray 375 features four staggered dividers 376 parallel to the long side 320 of the frame 300 and utilize flanking vertical dividers 305 on each side of the tray 375.

The planar sheet 500 is a flat paper product adapted to be curved and bent around the interior frame 300. In the preferred embodiment, the paper composition of the planar sheet 500 is suitable for high quality printing of a graphic element. In the fourth embodiment, the planar sheet is rectangular with a front side 501, a back side 502, two long edges 520 and two short edges 521, one of which has an attachment strip 510. For purposes of describing positioning of the elements of the planar sheet 500 and the attachment panel 700, the long edges 520 will be used as reference. In the preferred embodiment, the front side 501 will include a graphic element, such as advertising. Additionally, in this embodiment, the top long edge 522 is characterized by a central divot, so that the top edge 522 extends substantially lower than the interior frame 300 when the planar sheet is installed.

The planar sheet 500 is secured to the interior frame 300 through use of an attachment strip 510 with multiple tabs 511. In its installed position, the planar sheet 500 is wrapped around the interior frame 300 abutting the exterior edge 330 of the horizontal dividers 306. In this manner, the planar sheet 500 conforms to the shape of the horizontal dividers 306 to form an arcuate exterior shell. The attachment strip 510 includes multiple tabs on one short side 521 of the planar sheet which can secure to the interior frame 300 or to a backing sheet 380 attached to the interior frame 300. The tabs (not shown) are positioned to correspond with the attachment slots on the interior frame 300 and feature a rectangular portion with two flaps foldably connected to the portion, allowing for the flaps to be moved to insert into the frame 300. The planar sheet 500 may be attached by a folded tab, adhesive, or a hook and loop type system, however, in the preferred embodiment, the removable nature of multiple tabs allows for replacement of the planar sheet 500 during various advertising campaigns, thereby allowing for continual use of the interior frame 300.

The planar sheet 500 includes multiple apertures 525 along the length 521 of the sheet 500. The apertures 525 may be cut into the sheet 500 in any way typical with the industry, but the preferred embodiment provides die-cut apertures 525 to provide a clean edge 526 around the aperture 525. The apertures 525 can be cut into any shape. The placement of the apertures 525 coincides in proximity with the storage spaces 312 of the interior frame, thereby allowing access through the planar sheet 500 to the goods located in the storage space 312.

As shown in FIGS. 36-42, the display 100 consists of an interior frame 300, which may be composed of a paperboard material, corrugated material, or thin walled plastic, a planar sheet 500, which may be composed of a paperboard material, corrugated material, or thin walled plastic, and an attachment panel 700, which may be composed of a paperboard, corrugated material or a thin walled plastic.

The interior frame 300 of the fifth embodiment is composed of vertical dividers 305 and horizontal dividers 306 that are interlocking to form a rectangular frame with a two central exterior shelves 350. The interior frame has four equal sides, two sides 320 defined by interior shelving 312 and two sides 321 having exterior shelves 350. For purposes of describing positioning of the elements of the interior frame 300 and the attachment panel 700, the interior shelving side 320 will be used as reference. The uppermost horizontal divider 306 functions as the top panel 307 of the frame and the lowermost horizontal divider 306 function as a base panel 308 which may be attached to a pallet 800. Each horizontal divider 306 is parallel to the other dividers 306 has a multitude of slots (not shown), adapted to accommodate the placement of the vertical dividers 305 within the slots (not shown), and a multitude of slots (not shown), adapted to accommodate the attachment of the planar sheet 500. As shown, the present embodiment includes four horizontal dividers 306 forming three internal shelving spaces 312 and an two external shelving sections 350. The vertical dividers 305 are inserted through the horizontal dividers 306 parallel and perpendicular to the interior shelving side 320 of the frame 300. The vertical dividers may utilize friction, notches, tabs or other similar devices to maintain the position of the horizontal dividers 306 along the vertical length of the dividers 305. In this way, a parallel vertical divider 315 abutted by a perpendicular vertical divider 316 form two sides of a corner storage space 331. In this manner, multiple storage spaces 312 are defined by a top and bottom horizontal dividers 306, a back vertical divider, and two side vertical dividers along the length 320 of the frame 300. Each horizontal divider 306 has an edge (not shown) running the perimeter of the frame. The edge is characterized by a variation of straight portions and arcuate portions. The arcuate portions allow for the exterior of the frame to have a curved element which in turn creates a curve for the exterior shell when the planar sheet 500 is installed.

The fifth embodiment utilizes a rectangular frame with a two central exterior shelves 350 cut into the planar sheet 500 and exterior to the interior frame 300. The interior frame 300 has attachment ports (not shown) which allow for the supporting the exterior shelves to connect to the interior frame 300 to provide stability.

The planar sheet 500 is a flat paper product adapted to be curved and bent around the interior frame 300. In the preferred embodiment, the paper composition of the planar sheet 500 is suitable for high quality printing of a graphic element. In the fifth embodiment, the planar sheet is rectangular with a front side 501, a back side 502, two long edges 520 and two short edges 521, one of which has an attachment strip 510. For purposes of describing positioning of the elements of the planar sheet 500 and the attachment panel 700, the long edges 520 will be used as reference. In the preferred embodiment, the front side 501 will include a graphic element, such as advertising. Additionally, the top long edge 522 may be characterized by marketing shape, such as a logo or outline of a person, so that the top edge 522 extends substantially higher than the interior frame 300 when the planar sheet is installed.

The planar sheet 500 is secured to the interior frame 300 through use of an attachment strip 510 with multiple tabs 511. In its installed position, the planar sheet 500 is wrapped around the interior frame 300 abutting the exterior edge 330 of the horizontal dividers 306. In this manner, the planar sheet 500 conforms to the shape of the horizontal dividers 306 to form an arcuate exterior shell. The attachment strip 510 includes multiple tabs 511 on one short side 521 of the planar sheet which can secure to the interior frame 300 or to a backing sheet 380 attached to the interior frame 300. The tabs are positioned to correspond with the attachment slots on the interior frame 300 and feature a rectangular portion with two flaps foldably connected to the portion, allowing for the flaps to be moved to insert into the frame 300. The planar sheet 500 may be attached by a folded tab, adhesive, or a hook and loop type system, however, in the preferred embodiment, the removable nature of multiple tabs 511 allows for replacement of the planar sheet 500 during various advertising campaigns, thereby allowing for continual use of the interior frame 300.

The planar sheet 500 includes multiple apertures 525 along the length 520 of the sheet 500. The apertures 525 may be cut into the sheet 500 in any way typical with the industry, but the preferred embodiment provides die-cut apertures 525 to provide a clean edge 526 around the aperture 525. The apertures 525 can be cut into any shape. The placement of the apertures 525 coincides in proximity with the storage spaces 312 of the interior frame, thereby allowing access through the planar sheet 500 to the goods located in the storage space 312. In this embodiment, the planar sheet 500 also includes apertures 560 allowing for the insertion of the exterior shelving 350. In this manner, the apertures 560 provide access for the shelving 350 to the interior frame 300 and provide a seamless appearance to the viewer for the graphic element around the shelving 350.

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A display apparatus for displaying at least one item, the display apparatus comprising:

an interior frame having multiple horizontal dividers and multiple vertical dividers, said multiple horizontal dividers each with an exterior edge having an arcuate portion and a straight portion, said multiple vertical dividers and multiple horizontal dividers defining a storage space;

a planar sheet wrapped around said interior frame along said exterior edge of said multiple parallel horizontal dividers to form an arcuate exterior shell, said planar sheet having a backing and an opposing front side, said backing comprising a side flap having multiple tabs adapted to secure to said interior frame and a base flap having multiple tabs adapted to secure to said interior frame.

2. The display apparatus of claim 1, said planar sheet having a front side with a graphic element.

3. The display apparatus of claim 2, further comprising at least one horizontal divider abutting the front side of said planar sheet.

4. The planar sheet of claim 1, further comprising at least one aperture proximate said storage space.

5. The planar sheet of claim 1, said multiple tabs adapted to move between a first access position and a second locking position.

6. The planar sheet of claim 1, further comprising an attachment strip with multiple tabs adapted to secure said planar sheet to said interior frame.

7. The display apparatus of claim 1, further comprising a shipping pallet.

8. The planar sheet of claim 1, said backing further comprising a reinforcing margin.

9. A display apparatus for displaying at least one item, the display apparatus comprising:

an interior frame having multiple horizontal dividers and multiple vertical dividers, each with an exterior edge having an arcuate portion and a straight portion, said multiple vertical dividers and multiple horizontal dividers defining a storage space;

a planar sheet having at least one aperture proximate said storage space, said planar sheet wrapped around said interior frame along said exterior edge of said multiple parallel horizontal dividers to form an arcuate exterior shell; and, an attachment panel proximate to said planar sheet proximate to said straight portion of said multiple parallel horizontal dividers, said attachment panel having multiple tabs adapted to secure to said interior frame.

10. The display apparatus of claim 9, said planar sheet having a front side with a graphic element.

11. The display apparatus of claim 10, further comprising at least one horizontal divider abutting the front side of said planar sheet.

12. The planar sheet of claim 9, further comprising an attachment strip with multiple tabs adapted to secure said planar sheet to said interior frame.

13. The display apparatus of claim 9, said attachment panel attached to said planar sheet.

14. The attachment panel of claim 9, further comprising a side flap foldably joined to said attachment panel and a base flap foldably joined to said attachment panel.

15. The display apparatus of claim 9, said attachment panel further comprising a reinforcing margin providing a backing to said planar sheet.

16. A display apparatus for displaying at least one item, the display apparatus comprising:

an interior frame comprising a base, multiple vertical dividers and multiple parallel horizontal dividers each with an exterior edge having an arcuate portion and a straight portion, said multiple vertical dividers and said multiple parallel horizontal dividers defining multiple storage spaces;

a planar sheet comprising a front side with a graphic element;

multiple apertures, one of each of said multiple apertures proximate one of said multiple storage spaces; and an attachment strip adapted to secure said planar sheet to said interior frame, said planar sheet wrapped around said interior frame along said exterior edge of said multiple parallel horizontal dividers to form an arcuate exterior shell;

an attachment panel proximate to and attached to said planar sheet proximate to said straight portion of said multiple parallel horizontal dividers, said attachment panel comprising a side flap foldably joined to said attachment panel and a base flap foldably joined to said attachment panel, said side flap and said base flap having multiple tabs adapted to secure to said interior frame; and a shipping pallet proximate the base of said interior frame.

17. The display apparatus of claim 16, further comprising at least one horizontal divider abutting the front side of said planar sheet.

18. The display apparatus of claim 16, said attachment panel further comprising a reinforcing margin providing a backing to said planar sheet.

* * * * *